US010239666B2

(12) United States Patent
Vidal et al.

(10) Patent No.: US 10,239,666 B2
(45) Date of Patent: Mar. 26, 2019

(54) CLOSURES FOR A PRODUCT RETAINING CONTAINER AND RELATED SYSTEMS AND METHODS

(71) Applicant: Nomacorc LLC, Zebulon, NC (US)

(72) Inventors: Stéphane Vidal, Pujaut (FR); Jean Baptiste Dieval, Orange (FR); Malcolm Joseph Thompson, Raleigh, NC (US); Olav Marcus Aagaard, Rotterdam (NL); Katherine Campbell Glasgow, Wake Forest, NC (US)

(73) Assignee: VINVENTIONS USA, LLC, Zebulon, NC (US)

( * ) Notice: Subject to any disclaimer, the term of this patent is extended or adjusted under 35 U.S.C. 154(b) by 0 days.

(21) Appl. No.: 13/674,164

(22) Filed: Nov. 12, 2012

(65) Prior Publication Data

US 2013/0118924 A1 May 16, 2013

Related U.S. Application Data

(60) Provisional application No. 61/558,599, filed on Nov. 11, 2011.

(51) Int. Cl.
*B65D 39/00* (2006.01)
*B65B 31/00* (2006.01)
(Continued)

(52) U.S. Cl.
CPC ..... *B65D 39/0005* (2013.01); *B65B 31/00* (2013.01); *B65D 39/0058* (2013.01);
(Continued)

(58) Field of Classification Search
CPC ..... B65D 39/0011; B65D 39/0058; B65D 39/0005; B65D 39/00; B65D 81/2084;
(Continued)

(56) References Cited

U.S. PATENT DOCUMENTS 3,135,410 A 6/1964 Federighi
3,651,841 A 3/1972 Ohlsson
(Continued)

FOREIGN PATENT DOCUMENTS

AU 2012224574 A1 5/2013
CL 1950-2002 8/2003
(Continued)

OTHER PUBLICATIONS

Alonso, Angeles et al., "Determination of Antioxidant Power of Red and White Wines by a New Electrochemical Method and Its Correlation with Polyphenolic Content," Journal of Agricultural and Food Chemistry, vol. 50, American Chemical Society, Apr. 30, 2002, pp. 3112-3115.
(Continued)

*Primary Examiner* — Robert Poon
(74) *Attorney, Agent, or Firm* — Withrow & Terranova, P.L.L.C.

(57) ABSTRACT

Container closures wherein at least one void comprised in the closure is at least partially filled with a gas or gaseous mixture which by composition or pressure is different from air are disclosed. The oxygen content of said gas can be lower than the oxygen content of air. Through use of such closures for sealing closed containers, the amount of air and therefore oxygen that enters the closed container through closure desorption can be effectively controlled, changed, or even largely eliminated.

41 Claims, 4 Drawing Sheets

(51) Int. Cl.
*B65D 81/20* (2006.01)
*B65D 51/24* (2006.01)

(52) U.S. Cl.
CPC ..... *B65D 51/24* (2013.01); *B65D 81/2069* (2013.01); *B65D 81/2076* (2013.01); *B65D 81/2084* (2013.01)

(58) Field of Classification Search
CPC . B65D 81/2069; B65D 81/20; B65D 81/2023
USPC ..... 215/364; 206/0.6, 0.7
See application file for complete search history.

(56) References Cited

U.S. PATENT DOCUMENTS

| | | | | |
|---|---|---|---|---|
| 4,134,491 | A * | 1/1979 | Turillon et al. | 206/0.7 |
| 4,150,744 | A | 4/1979 | Fennimore | |
| 5,024,130 | A | 6/1991 | Hays, Jr. | |
| 5,179,171 | A | 1/1993 | Minami et al. | |
| 5,480,915 | A | 1/1996 | Burns | |
| 5,501,525 | A * | 3/1996 | Cox | B65D 31/04 206/524.8 |
| 5,904,965 | A * | 5/1999 | Noel | B32B 5/32 215/355 |
| 6,022,816 | A * | 2/2000 | Dewar | B65D 39/00 442/104 |
| 6,085,923 | A | 7/2000 | Yaniger | |
| 6,153,275 | A | 11/2000 | Yaniger | |
| 6,221,450 | B1 | 4/2001 | Noel et al. | |
| 6,221,451 | B1 | 4/2001 | Lauer et al. | |
| 6,355,320 | B1 | 3/2002 | Allman et al. | |
| 6,548,598 | B2 | 4/2003 | Takeuchi et al. | |
| 6,613,406 | B1 | 9/2003 | Yaniger | |
| 6,651,834 | B2 * | 11/2003 | Wong | B65D 81/2038 116/266 |
| 7,285,315 | B2 * | 10/2007 | Fragola | 428/158 |
| 7,314,661 | B2 | 1/2008 | Hueto | |
| 7,770,747 | B2 | 8/2010 | Lauer et al. | |
| 8,063,163 | B2 | 11/2011 | Hatke et al. | |
| 8,092,877 | B2 | 1/2012 | Jester et al. | |
| 8,283,394 | B2 | 10/2012 | Pfaadt | |
| 2002/0103275 | A1 | 8/2002 | Nogueria de Sousa | |
| 2002/0180083 | A1 * | 12/2002 | Yaniger | B29C 47/0016 264/46.1 |
| 2003/0161985 | A1 | 8/2003 | Lauer | |
| 2005/0137073 | A1 * | 6/2005 | Weaver | 493/394 |
| 2005/0208244 | A1 * | 9/2005 | Delmas | B29C 44/50 428/36.5 |
| 2006/0006132 | A1 | 1/2006 | Lauer et al. | |
| 2006/0021487 | A1 | 2/2006 | Dickover et al. | |
| 2006/0096468 | A1 * | 5/2006 | Paine | B65D 75/585 99/473 |
| 2007/0071939 | A1 | 3/2007 | Hueto | |
| 2007/0128387 | A1 | 6/2007 | Unwin et al. | |
| 2007/0163128 | A1 | 7/2007 | Tarrerias | |
| 2007/0203266 | A1 | 8/2007 | Holmes et al. | |
| 2008/0000337 | A1 | 1/2008 | Dickover et al. | |
| 2008/0229569 | A1 | 9/2008 | Romao de Sousa | |
| 2008/0300345 | A1 | 12/2008 | Pfaadt | |
| 2009/0253818 | A1 | 10/2009 | Kimura et al. | |
| 2010/0200606 | A1 | 8/2010 | Davis et al. | |
| 2011/0184082 | A1 | 7/2011 | Wright et al. | |
| 2011/0290757 | A1 * | 12/2011 | Purdy | B65D 39/0058 215/364 |
| 2012/0021151 | A1 | 1/2012 | Tatarka et al. | |
| 2013/0327739 | A1 | 12/2013 | Davidts et al. | |
| 2013/0328232 | A1 | 12/2013 | Bost et al. | |
| 2014/0299570 | A1 | 10/2014 | Davidts et al. | |
| 2016/0051946 | A1 * | 2/2016 | Paetzold | B65D 39/00 426/405 |

FOREIGN PATENT DOCUMENTS

| | | | |
|---|---|---|---|
| CN | 1124968 | A | 6/1996 |
| CN | 2380524 | Y | 5/2000 |
| CN | 2380584 | Y | 5/2000 |
| CN | 1362929 | A | 8/2002 |
| CN | 1486266 | A | 3/2004 |
| CN | 1900405 | A | 1/2007 |
| CN | 101203438 | A | 6/2008 |
| CN | 101384666 | A | 3/2009 |
| CN | 101558120 | A | 10/2009 |
| CN | 101861274 | A | 10/2010 |
| CN | 102361801 | A | 2/2012 |
| CN | 102388241 | A | 3/2012 |
| CN | 102707022 | A | 10/2012 |
| DE | 2928499 | A1 | 11/1980 |
| DE | 202009012131 | U1 | 3/2010 |
| EP | 1908567 | A1 | 4/2008 |
| FR | 2441467 | A1 | 6/1980 |
| FR | 2703028 | A1 | 9/1994 |
| FR | 2799183 | A1 | 4/2001 |
| FR | 2850634 | A1 | 8/2004 |
| GB | 1499852 | | 2/1978 |
| JP | 2003081297 | A | 3/2003 |
| JP | 2006275751 | A | 10/2006 |
| WO | 9425513 | A1 | 11/1994 |
| WO | 9847783 | A1 | 10/1998 |
| WO | 0026103 | A1 | 5/2000 |
| WO | 03018304 | A1 | 3/2003 |
| WO | 03082700 | A1 | 10/2003 |
| WO | 2006094529 | A1 | 9/2006 |
| WO | 2007040608 | A1 | 4/2007 |
| WO | 2008048129 | A1 | 4/2008 |
| WO | 2008063458 | A2 | 5/2008 |
| WO | 2009063095 | A2 | 5/2009 |
| WO | 2010092046 | A1 | 8/2010 |
| WO | 2012120101 | A1 | 9/2012 |
| WO | 2012120109 | A1 | 9/2012 |

OTHER PUBLICATIONS

Celotti, Emilio et al., "The analytical evaluation of wine oxidability," The Australian & New Zealand Grapegrower & Winemaker, Ryan Publications Pty. Ltd., Feb. 2006, pp. 47-52.

Kilmartin, Paul et al., "A Cyclic Voltammetry Method Suitable for Characterizing Antioxidant Properties of Wine and Wine Phenolics," Journal of Agricultural and Food Chemistry, vol. 49, American Chemical Society, Mar. 10, 2001, pp. 1957-1965.

Rodrigues, Astride et al., "Resistance to Oxidation of White Wines Assessed by Voltammetric Means," Journal of Agricultural and Food Chemistry, vol. 55, American Chemical Society, Nov. 23, 2007, pp. 10557-10562.

International Search Report and Written Opinion for PCT/US2013/071242 dated Jan. 16, 2014, 11 pages.

International Search Report and Written Opinion for PCT/US13/44475 dated Oct. 10, 2013, 10 pages.

Diéval et al., "Measurement of the Oxygen Transmission Rate of Co-extruded Wine Bottle Closures Using a Luminescence-Based Technique", Packaging Technology and Science—Wiley Online Library, 2011, www.wileyonlinelibrary.com, 11 pages.

International Search Report for PCT/EP2012/072155, dated Feb. 15, 2013, 11 pages.

Final Office Action for U.S. Appl. No. 13/911,434, dated May 5, 2016, 15 pages.

Final Office Action for U.S. Appl. No. 14/175,266, dated Apr. 19, 2016, 9 pages.

English Translation of Notification of the First Office Action for Chinese Patent Application No. 201380060842.X, dated Mar. 2, 2016, 14 pages.

Non-Final Office Action for U.S. Appl. No. 13/911,477, dated Feb. 26, 2016, 9 pages.

Maren, "Wine Cork Wreath—Part 1," a constant project, Nov. 2, 2010, 3 pages, http://aconstantproject.blogspot.de/2010/11/wine-cork-wreath-part-1.html.

Extended European Search Report for European Patent Application No. 13800082.3, dated Feb. 26, 2016, 6 pages.

Intenational Preliminary Report on Patentability for PCT/US2014/015313, completed Jul. 7, 2015, 18 pages.

(56) References Cited

OTHER PUBLICATIONS

Non-Final Office Action for U.S. Appl. No. 13/911,434, dated Mar. 9, 2017, 14 pages.
Notice of Allowance for U.S. Appl. No. 13/911,477, dated Feb. 27, 2017, 7 pages.
Final Office Action for U.S. Appl. No. 14/246,627, dated May 22, 2017, 25 pages.
Notification of the Second Office Action for Chinese Patent Application No. 201480001531.0, dated Jul. 18, 2016, 22 pages.
Non-Final Office Action for U.S. Appl. No. 14/086,367, dated Aug. 26, 2016, 7 pages.
Advisory Action and Examiner-Initiated Interview Summary for U.S. Appl. No. 13/911,434, dated Aug. 26, 2016, 6 pages.
Final Office Action for U.S. Appl. No. 13/911,477, dated Aug. 26, 2016, 12 pages.
Advisory Action for U.S. Appl. No. 14/175,266, dated Aug. 9, 2016, 3 pages.
Non-Final Office Action for U.S. Appl. No. 14/246,627, dated Oct. 12, 2016, 18 pages.
Non-Final Office Action for U.S. Appl. No. 14/086,367, dated Jun. 30, 2017, 7 pages.
Examiner's Answer for U.S. Appl. No. 14/175,266, dated Aug. 31, 2017, 8 pages.
Advisory Action for U.S. Appl. No. 14/246,627, dated Aug. 28, 2017, 9 pages.
Examination Report for European Patent Application No. 14721710.3, dated Nov. 8, 2017, 4 pages.
Examination Report for European Patent Application No. 14706738.3, dated Nov. 10, 2017, 7 pages.
Final Office Action for U.S. Appl. No. 13/911,434, dated Dec. 21, 2017, 17 pages.
Translated Summary of the First Examination Report for Chilean Patent Application No. 1232-2014, dated Jun. 21, 2017, 2 pages.
First Examination Report for Chilean Patent Application No. 2014-003320, dated Jan. 3, 2018 (10 pages including English translation).
First Examination Report for Chilean Patent Application No. 2014-003323, dated Jan. 5, 2018 (10 pages including English translation).
Notice of Allowance for U.S. Appl. No. 14/246,627, dated Mar. 8, 2018, 10 pages.
Author Unknown, "Standard Test Method for Oxygen Transmission Rate Through Dry Packages Using a Coulometric Sensor," ASTM Standard F1307-02, ASTM International, 2007, 7 pages.
Avramescu, Alina et al., "Screen-printed biosensors for the control of wine quality based on lactate and acetaldehyde determination," Analytica Chimica Acta, vol. 458, Elsevier Science B.V., Apr. 29, 2002, pp. 203-213.
Caille, Soline et al., "Sensory characteristics changes of red Grenache wines submitted to different oxygen exposures pre and post bottling," Analytica Chimica Acta, vol. 660, Elsevier B.V., Available online Dec. 3, 2009, pp. 35-42.
Crank, John, "The Mathematics of Diffusion (Second Edition)," Clarendon Press, Oxford, 1975, pp. 45-53.
Crochiere, George K., "Measuring oxygen ingress during bottling/storage," Practical Winery and Vineyard Journal, Wine Communications Group, Jan./Feb. 2007, pp. 74-84.
Du Toit, W.J. et al., "Oxygen in Must and Wine: A review," South African Journal of Enology and Viticulture, vol. 27, No. 1, 2006, pp. 76-94.
Barroso, M.F. et al., "Towards a reliable technology for antioxidant capacity and oxidative damage evaluation: Electrochemical (bio)sensors," Biosensors and Bioelectronics, vol. 30, Issue 1, Elsevier B.V., Available online Sep. 3, 2011, pp. 1-12.
Godden, Peter et al., "Wine bottle closures: physical characteristics and effect on composition and sensory properties of a Semillon wine, 1. Performance up to 20 months post-bottling," Australian Journal of Grape and Wine Research, vol. 7, Issue 2, Jul. 2001, pp. 64-105.
Guan, Wen-Jun et al., "Glucose biosensor based on multi-wall carbon nanotubes and screen printed carbon electrodes," Biosensors and Bioelectronics, vol. 21, Issue 3, Elsevier B.V., Sep. 15, 2005, pp. 508-512.
Liu, Jifeng et al., "Antioxidant Redox Sensors Based on DNA Modified Carbon Screen-Printed Electrodes," Analytical Chemistry, vol. 78, No. 19, American Chemical Society, Oct. 1, 2006, pp. 6879-6884.
Liu, Jifeng et al., "Antioxidant Sensors Based on DNA Modified Electrodes," Analytical Chemistry, vol. 77, No. 23, American Chemical Society, Dec. 1, 2005, pp. 7687-7694.
Lopes, Paulo et al., "Impact of Oxygen Dissolved at Bottling and Transmitted through Closures on the Composition and Sensory Properties of a Sauvignon Blanc Wine during Bottle Storage," Journal of Agricultural and Food Chemistry, vol. 57, No. 21, American Chemical Society, Nov. 11, 2009, pp. 10261-10270.
Lopes, Paulo et al., "Main Routes of Oxygen Ingress through Different Closures into Wine Bottles," Journal of Agricultural and Food Chemistry, vol. 55, No. 13, American Chemical Society, Jun. 27, 2007, pp. 5167-5170.
Lopes, Paulo et al., "Nondestructive Colorimetric Method to Determine the Oxygen Diffusion Rate through Closures Used in Winemaking," Journal of Agricultural and Food Chemistry, vol. 53, No. 18, American Chemical Society, Sep. 7, 2005, pp. 6967-6973.
Lundquist, L. et al., "Oxygen Transmission Rate Measurement Using Oxygen Sensitive Fluorescent Tracers," Presented at the Technical Association of the Pulp and Paper Industry PLACE Division Conference, Aug. 29-Sep. 2, 2004, Indianapolis, Indiana, 13 pages.
Makhotkina, Olga, "Uncovering the influence of antioxidants on polyphenol oxidation in wines using an electrochemical method: Cyclic voltammetry," Journal of Electroanalytical Chemistry, vol. 633, Elsevier B.V., Available online May 27, 2009, pp. 165-174, 2009.
Mello, L.D., "Biosensors as a tool for the antioxidant status evaluation," Talanta, vol. 72, Elsevier B.V., Available online Jan. 4, 2007, pp. 335-348.
Pocas, Maria F. et al., "Measurement of Oxygen Transmission Rate through Foamed Materials for Bottle Closures," Packaging Technology and Science, vol. 23, Issue 1, John Wiley & Sons, Ltd., Jan./Feb. 2010, pp. 27-33.
Rabiot, Dominique et al., "Study of the Oxygen Transfer Through Synthetic Corks for Wine Conservation," American Institute of Chemical Engineers, Jan. 1, 1999, 15 pages.
Skouroumounis, George et al., "Oxygen ingress into bottled wine," Practical Winery and Vineyard Journal, Wine Communications Group, Jul./Aug. 2008, pp. 6-14.
Silva Ferreira, Antonio Cesar et al., "Identification of Key Odorants Related to the Typical Aroma of Oxidation-Spoiled White Wines," Journal of Agricultural and Food Chemistry, vol. 51, No. 5, American Chemical Society, Feb. 26, 2003, pp. 1377-1381.
Squarzoni, Margherita et al., "Innovative method for the evaluation of oxygen barrier properties of some different kinds of wine stoppers," Industrie delle Bevande, vol. 33, Apr. 2004, pp. 113-116.
Wirth, J. et al., "The impact of oxygen exposure before and after bottling on the polyphenolic composition of red wines," Food Chemistry, vol. 123, Elsevier Ltd., Nov. 1, 2010, pp. 107-116.
Australian Patent Examination Report for Patent Application No. 2013204683 dated Mar. 21, 2014, 4 pages.
International Search Report and Written Opinion for PCT/US2014/015313 dated May 23, 2014, 10 pages.
International Search Report and Written Opinion for PCT/US2014/033177 dated Jun. 6, 2014, 10 pages.
ASTM Standard D792, "Standard Test Methods for Density and Specific Gravity (Relative Density) of Plastics by Displacement," ASTM International, 2013, 6 pages.
ASTM Standard D1238, "Standard Test Method for Melt Flow Rates of Thermoplastics by Extrusion Plastometer," ASTM International, 2013, 16 pages.
ASTM Standard D1525, "Standard Test Method for Vicat Softening Temperature of Plastics," ASTM International, 2009, 10 pages.

(56) References Cited

OTHER PUBLICATIONS

ASTM Standard D1928, "Standard Practice for Preparation of Compression-Molded Polyethylene Test Sheets and Test Specimens," ASTM International, 1996, 7 pages.
ISO Standard 306, "Plastics—Thermoplastic materials—Determination of Vicat softening temperature (VST)," International Organization for Standardization, 2013, 24 pages.
ISO Standard 527, "Plastics—Determination of tensile properties—Part 1: General principles," International Organization for Standardization, 2012, 28 pages.
ISO Standard 815, "Rubber, vulcanized or thermoplastic—Determination of compression set—Part 1: At ambient or elevated temperatures," International Organization for Standardization, 2014, 18 pages.
ISO Standard 868, "Plastics and ebonite—Determination of indentation hardness by means of a durometer (Shore hardness)," International Organization for Standardization, 2003, 6 pages.
ISO Standard 1183, "Plastics—Methods for determining the density of non-cellular plastics—Part 1: Immersion method, liquid pyknometer method and titration method," International Organization for Standardization, 2012, 16 pages.
ISO Standard 2030, "Granulated cork—Size analysis by mechanical sieving," International Organization for Standardization, 1990, 4 pages.
Martins, Rui C. et al., "Oxidation Management of White Wines Using Cyclic Voltammetry and Multivariate Process Monitoring," Journal of Agricultural and Food Chemistry, vol. 56, American Chemical Society, Nov. 19, 2008, pp. 12092-12098.
Prieto-Simón, B. et al., "Electrochemical biosensors as a tool for antioxidant capacity assessment," Sensors and Actuators B: Chemical, vol. 129, Issue 1, Elsevier B.V., Jan. 29, 2008, pp. 459-466.
International Preliminary Report on Patentability for International Patent Application No. PCT/EP2013/061433, dated Oct. 21, 2014, 17 pages.
Australian Patent Examination Report for Australian Patent Application No. 2013204654, dated Jan. 21, 2015, 3 pages.
International Preliminary Report on Patentability for International Patent Application No. PCT/US2013/044475, dated Dec. 18, 2014, 9 pages.
Canadian Examination Search Report for Canadian Patent Application No. 2,855,255, dated Jan. 27, 2015, 4 pages.
Australian Patent Examination Report for Australian Patent Application No. 2013204648, dated Jan. 22, 2015, 4 pages.
Non-final Office Action for U.S. Appl. No. 13/911,434, dated Jan. 29, 2015, 19 pages.
International Preliminary Report on Patentability for PCT/US2013/071242, dated Jun. 4, 2015, 7 pages.
Non-Final Office Action for U.S. Appl. No. 13/911,477, dated May 12, 2015, 13 pages.
European Patent Examination Report for European Patent Application No. 12787419.6, dated May 27, 2015, 4 pages.
Non-Final Office Action for U.S. Appl. No. 13/911,434, dated Jul. 14, 2015, 14 pages.
Notification of the First Office Action for Chinese Patent Application No. 2012800668445, dated Jul. 27, 2015, 35 pages.
International Preliminary Report on Patentability for PCT/US2014/033177, dated Oct. 15, 2015, 8 pages.
Non-Final Office Action for U.S. Appl. No. 14/175,266, dated Sep. 16, 2015, 9 pages.
Notification of the First Office Action for Chinese Patent Application No. 201380039735.9, dated Sep. 15, 2015, 25 pages.
Notification of the First Office Action for Chinese Patent Application No. 201480001531.0, dated Oct. 8, 2015, 23 pages.
Australian Patent Examination Report for Australian Patent Application No. 2013204654, dated Jan. 20, 2016, 3 pages.
Examination Search Report for Canadian Patent Application No. 2,875,439, dated Mar. 10, 2015, 4 pages.
Examination Search Report for Canadian Patent Application No. 2,875,439, dated Nov. 16, 2015, 7 pages.
Australian Patent Examination Report for Australian Patent Application No. 2013204663, dated Dec. 9, 2014, 4 pages.
Examination Search Report for Canadian Patent Application No. 2,875,608, dated Feb. 24, 2015, 3 pages.
Examination Search Report for Canadian Patent Application No. 2,875,608, dated Nov. 20, 2015, 3 pages.
Examination Report for European Patent Application No. 138000823, dated Sep. 21, 2017, 5 pages.
Examination Report for European Patent Application No. 13728148.1, dated Dec. 11, 2015, 4 pages.
First Examination Report for Chilean Patent Application No. 2015-001303, dated Apr. 26, 2017, 16 pages.
Notification of the Second Office Action Office Action for Chinese Patent Application No. 201380060842.X, dated Nov. 9, 2016, 24 pages.
Notification of the Third Office Action Office Action for Chinese Patent Application No. 201380060842.X, dated Jul. 28, 2017, 25 pages.
Examination Report for European Patent Application No. 13799174.1, dated Dec. 22, 2016, 6 pages.
Examination Report for European Patent Application No. 13799174.1, dated Jan. 10, 2018, 8 pages.
Australian Patent Examination Report for Australian Patent Application No. 2013205007, dated Apr. 16, 2015, 6 pages.
Examination Search Report for Canadian Patent Application No. 2,875,675, dated Mar. 5, 2015, 5 pages.
Examination Search Report for Canadian Patent Application No. 2,875,675, dated Nov. 27, 2015, 6 pages.
Notification of the Third Office Action for Chinese Patent Application No. 201480001531.0, dated Jan. 26, 2017, 29 pages.
Notification of the Fourth Office Action for Chinese Patent Application No. 201480001531.0, dated Oct. 25, 2017, 27 pages.
Australian Patent Examination Report for Australian Patent Application No. 2013204542, dated Apr. 16, 2015, 5 pages.
Examination Report for European Patent Application No. 14721710.3, dated Oct. 13, 2016, 7 pages.
Examination Report for European Patent Application No. 14721710.3, dated Apr. 12, 2017, 6 pages.
Examination Report for European Patent Application No. 14721710.3, dated Feb. 20, 2018, 4 pages.
Examination Report for European Patent Application No. 12787419.6, dated Mar. 24, 2016, 6 pages.
Examination Report for European Patent Application No. 12787419.6, dated Oct. 28, 2016, 4 pages.
Examination Report for European Patent Application No. 12787419.6, dated Sep. 6, 2017, 4 pages.
Notification of the Second Office Action for Chinese Patent Application No. 2012800668445, dated Apr. 1, 2016, 9 pages.
Notification of the Third Office Action for Chinese Patent Application No. 2012800668445, dated Oct. 8, 2016, 8 pages.
Notification of the Fourth Office Action for Chinese Patent Application No. 2012800668445, dated Jun. 2, 2017, 8 pages.
Notification of the First Office Action for Chinese Patent Application No. 201380039744.8, dated Sep. 2, 2015, 31 pages.
Notification of the Second Office Action for Chinese Patent Application No. 201380039744.8, dated Jul. 18, 2016, 27 pages.
Notification of the Third Office Action for Chinese Patent Application No. 201380039744.8, dated Feb. 4, 2017, 10 pages.
Notification of the Fourth Office Action for Chinese Patent Application No. 201380039744.8, dated Oct. 20, 2017, 8 pages.
Decision on Appeal for U.S. Appl. No. 14/175,266, dated Oct. 5, 2018, 6 pages.
Author Unknown, "Kraton G SEBS/SEPS," Product Specification, kraton.com:80/Products/Kraton_G_SEBS_SEPS, May 22, 2011, Kraton Performance Polymers Inc., 2 pages.
Non-final Office Action for U.S. Appl. No. 13/911,434, dated Jul. 26, 2018, 13 pages.
Non-Final Office Action for U.S. Appl. No. 14/086,367, dated May 4, 2018, 7 pages.
Notice of Allowance for U.S. Appl. No. 14/246,627, dated Jun. 27, 2018, 7 pages.

* cited by examiner

CLOSURES FOR A PRODUCT RETAINING CONTAINER AND RELATED SYSTEMS AND METHODS

PRIORITY APPLICATION

The present application claims priority to U.S. Provisional Patent Application Ser. No. 61/558,599, filed on Nov. 11, 2011, entitled "CLOSURE FOR A PRODUCT RETAINING CONTAINER," which is incorporated herein by reference in its entirety.

BACKGROUND

Field of the Disclosure

The disclosure relates to a closure for a product retaining container. Moreover, the disclosure relates to a use of a closure for closing a product retaining container and to a method of manufacturing said closure. The disclosure also relates to a closure system and a method for controlling and/or changing the gas composition and/or pressure within the head-space of product-retaining container and the use of a closure therein.

Technical Background

In view of the wide variety of products that are dispensed from containers, numerous constructions have evolved for container closures, including, for example, screw caps, stoppers, corks and crown caps, or the like. Generally, products such as vinegar, vegetable oils, laboratory liquids, detergents, honey, condiments, spices, alcoholic beverages, and the like, impose similar requirements on the type and construction of the closure means used for containers for these products. However, wine sold in bottles represents the most demanding product in terms of bottle closure technology, due to the numerous and burdensome requirements placed upon the closures used for wine bottles. In an attempt to best meet these demands, most wine bottle closures or stoppers have historically been produced from a natural material known as "cork".

While natural cork still remains a dominant material for wine closures, synthetic wine closures have become increasingly popular over the last years, largely due to the shortage in high quality natural cork material and the problem of wine spoilage as a result of "cork taint", a phenomenon that is associated with natural cork materials. In addition, synthetic closures have the advantage that by means of closure technology, their material content and physical characteristics can be designed, controlled and fine-tuned to satisfy the varying demands that the wide range of different wine types produced throughout the world impose on closures.

In closure technology, oxygen management is one of the most critical features. Oxygen is a key reactant that causes a sensory change in wine in its package. Moreover, oxygen is a major determinant of shelf life. In selecting an optimal closure for a particular type of wine, one has to strike a delicate balance between tightly sealing the bottle content to prevent leakage, avoid contaminants, counteract degradation and spoilage by oxidation, on the one hand, and, on the other hand, permitting a restricted amount of oxygen to enter the container, so as to ensure full maturation of the wine flavor characteristics and prevent the formation of unpleasant aromas. Recent scientific studies appear to confirm what has already been accepted empirical knowledge in the traditional art of winemaking: that oxygen is intimately involved in the aging and maturation process of bottled wine.

If certain types of wines are completely starved of oxygen for longer periods of time, a process known as reduction may give rise to malodorous sulfur compounds such as certain sulphides (sulfides), thiols and mercaptans. To prevent reduction over the entire period of wine aging and maturation, a minute but constant concentration of oxygen within the container interior is believed to be necessary. The olfactory defect occurring otherwise is sometimes referred to as reduced character and can be readily identified by the presence of odors reminiscent of rotten egg, garlic, stagnant water, burnt rubber, struck matches and/or cooked cabbage. Even at low concentrations, these odors may completely ruin a wine's character.

On the other hand, wines that are to be consumed young, such as most types of white wines, must be protected from oxygen as ingress of oxygen impairs the fresh and fruity appeal of these wines. However, also for other wines, marked oxidation has an adverse effect on wine quality.

Hence, there is a need for advanced bottling technology and superior closure types which allow winemakers to choose and exactly control the amount of oxygen that a wine is exposed to during bottling and bottle aging.

In bottled wine, the total oxygen present in the bottle (total package oxygen, TPO) is generally thought of as the sum of dissolved oxygen and the oxygen present in the air of the headspace (i.e. the ullage volume between fill level and closure), both of which can be derived from several sources. First, contact of the wine with air during bottle filling, can result in an increased amount of dissolved oxygen in the wine. Secondly, gaseous oxygen trapped in the bottle headspace after bottling and bottle closure is another major source of oxygen. The amount of oxygen present in the headspace can vary, depending on headspace volume, which is determined by bottle dimensions, fill level, and/or bottle neck space that is occupied by the closure, as well as the oxygen concentration in the gas phase occupying the head space. The amount of oxygen present in the gas phase after bottling can be reduced, for example, by applying headspace management technology such as, for example, evacuation (vacuum) or inerting (e.g. flushing with carbon dioxide or nitrogen) the headspace immediately before the bottle is closed. Thirdly, after bottling and during storage, oxygen ingress through the closure, as determined by the oxygen transfer rate (OTR) of the closure, may be responsible for additional oxygen uptake.

Finally, besides these three aforementioned routes of oxygen uptake, it has been found that immediately after closing wine bottles with natural or synthetic cork stoppers, off-gassing of air from the compressed cork material may further contribute to an initially high local oxygen concentration in the bottle headspace. Such off-gassing of the closure may be caused by the compression which the closure undergoes when being inserted into the bottleneck. The compression may lead to diffusion of air present in the cork in all directions possible, including into the bottle headspace. The ratio of air being forced into the bottle headspace compared to the proportion moving outside of the bottle will be determined inter alia by the pressure under the closure, with greater transfer into the headspace at more negative headspace pressures.

The off-gassing phenomenon, which has also been referred to as "desorption" of the closure (Dieval, J.-B. et al., Packag. Technolog. Sci. 2011 and references therein), becomes evident from curves depicting the oxygen ingression kinetics after bottle closure. Without wishing to be bound by theory such curves can generally be divided into two parts. In a first phase, there is a relatively fast and non-linear oxygen ingress into the bottle headspace. Later-on, in a second phase, which typically begins a couple of weeks to a year after bottling and lasts for the years of subsequent storage, the oxygen ingress rate is slower but constant and follows a linear curve, the slope of which is defined by the respective closure's OTR. The first faster and non-linear oxygen ingress is generally caused by the off-gassing of air, which was present in the closure and is forced out of the closure by the compression of the closure in the bottle neck after bottling. The second phase generally is the oxygen that diffuses from the outside atmosphere through the closure and into the bottle headspace. In the following, the gas ingress from within the closure, i.e. the first phase, will be referred to as closure desorption. This is used within the present disclosure synonymous to other suited terms such as off-gassing, outgassing of the closure or ingress of oxygen from within the closure itself upon closing. In particular, the use of the term desorption shall not limit the present disclosure to the physical phenomenon scientifically described as desorption. The term desorption as used in the description of the present disclosure is rather meant to include any release of a gas from the closure itself, which, by way of example, was trapped in the closure, e.g. in voids or cells present in the closure, or dissolved, adsorbed, chemically or otherwise bonded to the closure material and which is released into the interior of the container upon or after closing the container with said closure.

Advances in headspace management technology such as evacuation or inerting (e.g. flushing with nitrogen) the headspace before closing bottles have made it possible to minimize the starting amount of oxygen present in wine bottles after bottling. Though simple in principle, applying headspace management technology incurs additional costs for the wine maker. On the other hand, advances in (synthetic) closure technology have made it possible that winemakers today can select from a variety of different synthetic closures the optimal closure with an OTR, best-suited for their individual winemaking needs. However, to date there are no means to eliminate, control or change the amount of air and therefore oxygen that enters the closed container through closure desorption, the impact of which on wine aging, sensory properties and quality is only begun to be fully understood. The potentially high amount of oxygen initially entering the bottle through closure desorption, however, can lead to adverse effects and uncontrolled oxidation. There is a need for closures with a defined and controllable amount of oxygen being supplied to the bottle content. Thus, next to controlling closure OTR, there is a need for closure technology that allows control of closure desorption.

SUMMARY OF THE DETAILED DESCRIPTION

Embodiments disclosed herein provide for closures for product retaining containers.

While the closure may, in principle, relate to any kind of closure, due to the special requirements in the wine industry, the closure of the present disclosure is particularly useful as a closure for wine bottles such as, for example, a natural or synthetic cork stopper or a screw-cap closure.

Embodiments disclosed herein enable winemakers to choose a closure from a range of closures with distinct and consistent desorption and OTR values. This tailoring of the wine closure to the specific oxygen requirements of a particular type of wine, may allow wineries to optimize the oxygen-dependent flavor and wine character development for each of their wine product lines and at the same time prevent the formation of unpleasant aromas associated with reduction.

Embodiments of the present disclosure also provide closures wherein at least one void comprised in the closure is at least partially filled with a gas or gaseous mixture which by composition or pressure is different from air. In particular, the oxygen content of said gas can be lower than the oxygen content of air. The inventors have found that by providing and using the closures according to the present disclosure for sealing closed containers, the amount of air and therefore oxygen that enters the closed container through closure desorption can be effectively controlled, changed or even largely eliminated.

While embodiments of the present disclosure are well suited for use in the wine industry, the disclosure is not so limited. Rather, the concepts of the present disclosure can be extended to other containers that have a need for controlled oxygen ingress or total block of oxygen ingress.

BRIEF DESCRIPTION OF THE FIGURES

Further features and advantages of the embodiments disclosed herein will become apparent from the following detailed description of some of its embodiments shown by way of non-limiting examples in the accompanying drawings, in which:

FIG. 3*b* is an enlarged section of the cork material the closure shown in FIG. 3*a* is made of;

DETAILED DESCRIPTION

Figure 1:
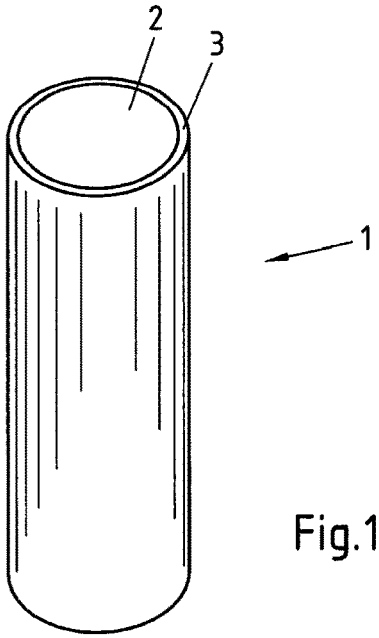
FIG. 1 is an exploded schematic view of a first exemplary embodiment of a closure according to one embodiment of the present disclosure.

By referring to FIGS. 1 to 8, along with the following detailed disclosure, the construction of the closure of the certain embodiments disclosed herein can best be understood.

In these Figures, as well as in the following detailed disclosure, the closure of one embodiment is depicted and discussed as a bottle closure for wine products. However, the embodiments can be applicable as a closure for use in sealing and retaining any desired product in any desired closure system. Due to the stringent and difficult demands and requirements placed upon closures for wine products, the following detailed disclosure focuses upon the applicability of the synthetic bottle closures of the embodiments as a closure for wine bottles. Nevertheless it is to be understood that this detailed discussion is provided merely for exemplary purposes and is not intended to limit the embodiments disclosed herein to this particular application and embodiment.

Embodiments disclosed herein provide for a closure for a product retaining container wherein the closure comprises at least one void, wherein at least one void is at least partially filled with a gas which by composition and/or pressure is different from air. In one exemplary embodiment at least one void is filled with a gas which by composition is different from air. In another exemplary embodiment, the at least one void can also have a pressure different from standard atmospheric pressure. In yet another exemplary embodiment of the disclosure, at least one void of said closure can be at least partially filled with a gas which by composition is different from air and has a pressure different from standard atmospheric pressure. The inventors have found that one of the effects of the closures according to the present disclosure may be that the gas composition and in particular the amount of air that enters the closed container through closure desorption can be effectively controlled, changed or even largely eliminated. It is to be understood that the closures described in the present disclosure are meant to be ready-to-use to be employed in sealing closed a product retaining container.

According to another exemplary embodiment of the disclosure, the gas with which at least one void of the closure is at least partially filled comprises a gas selected from the group consisting of an inert gas, nitrogen, argon, sulfur dioxide and carbon dioxide, and combinations thereof. In yet another exemplary embodiment of the present disclosure, the gas with which at least one void of the closure is at least partially filled is not sulfur dioxide or carbon dioxide.

In a further exemplary embodiment of the disclosure, at least one void of the closure is at least partially filled with a gas comprising > about 80 vol. % nitrogen.

As used herein the term "product retaining container" is meant to include bottles, jars, flasks, canisters, tins, vials and the like. In an exemplary embodiment, the product retaining container is a wine bottle.

The term "closure" as used herein applies to any means for effectively closing product retaining containers in general. Such closures include but are not limited to screw caps, stoppers, corks, crown caps, latches, seals and lids. According to one embodiment, the closure is selected from the group consisting of a bottle cap, such as a screw cap or a crown cap, and a cylindrically shaped bottle stopper. According to an embodiment, the material for the closure may, for example, be selected from the group consisting of metal, polymer material, glass, natural materials such as cork, ceramic, steel, and rubber and combinations thereof.

In an exemplary embodiment, the closure of the present disclosure may be a natural or synthetic stopper. Referring now to FIGS. 1 to 3 such stoppers 1 may have a substantially cylindrical shape and substantially flat terminating ends. They may be made of natural cork and/or of polymer material. According to one embodiment, these stoppers may have a cylindrically shaped core member 2 formed e.g. from foamed plastic material and at least one independent layer of foamed or non-foamed plastic material 3 peripherally surrounding and intimately bonded to the core member with the flat terminating end surfaces of the core member being devoid of said outer layer. Such synthetic stoppers and exemplary methods of their manufacture are described in U.S. Pat. No. 6,221,451 B1, which is hereby incorporated herein by reference in its entirety.

Figure 2A:
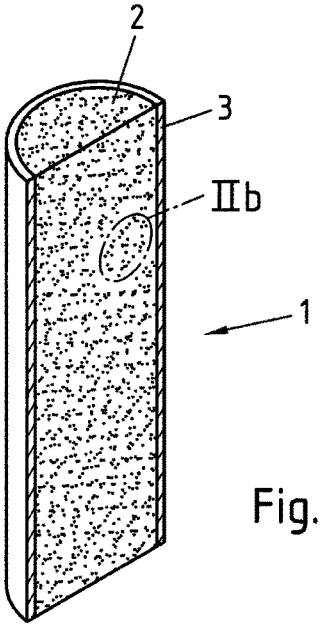
FIG. 2*a* is a longitudinal-section schematic view of a second exemplary embodiment of a closure according to one embodiment of the present disclosure, wherein the closure is made from plastic material and comprises a core member and an outer layer.
Figure 3A:
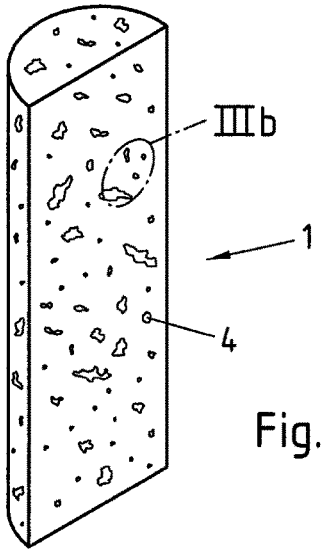
FIG. 3*a* is a longitudinal-section schematic view of a third exemplary embodiment of a closure according to one embodiment of the present disclosure, wherein the closure is made of natural cork.
Figure 2B:
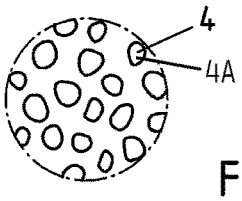
FIG. 2*b* is an enlarged section of the material of the core member of the closure shown in FIG. 2*a;*
Figure 3B:
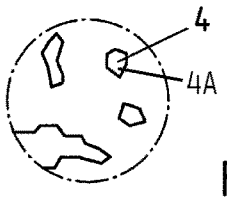

As used herein, the "at least one void" can be a single void, such as a gas compartment within the closure. In another embodiment, the at least one void can be a plurality of voids, which can be formed by cellular structures present in the materials out of which the closure is made. The term "void" as used herein is meant to include any kinds of cells, inclusions, gas pockets or reservoirs, tubular structures, pores and/or inter-connected voids as in sponge-like materials. In yet another exemplary embodiment the at least one void is the space inside the plurality of cells of a wholly or partially foamed synthetic closure. Referring now to FIGS. 2*a* and 2*b*, a closure 1 is illustrated in form of a synthetic bottle stopper. In this embodiment the at least one void 4 is the space inside the plurality of cells of the wholly or partially foamed core member 2 of synthetic closure 1. In another exemplary embodiment, the at least one void is the space inside the plurality of cells, inclusions and tubules present in natural cork stoppers. Referring now to FIGS. 3*a* and 3*b*, a closure 1 is illustrated in form of a stopper made from natural cork. In this embodiment the at least one void 4 is the space inside the plurality of cells, inclusions and tubules present in natural cork stopper 1. The at least one void can however also be the space inside cells present for example in a particular liner of a screw cap closure.

In one embodiment of this disclosure the closure comprises at least one void filled with a gas which by composition is different from air, such as the gas 4A shown in FIGS. 2*b* and 3*b*. A gas which by composition is different from air may, for example, comprise > about 80 vol. % nitrogen. In case of such a closure, upon closure desorption, a gas different from air will ingress into the product retaining container. Air generally has a gas composition of roughly about 78.09 vol. % nitrogen, about 20.95 vol. % oxygen, about 0.93 vol. % Ar, about 0.039 vol. % carbon dioxide, and small amounts of trace gases. Therefore, a gas comprising > about 80 vol. % nitrogen (or any other gas different from oxygen) has a lower oxygen content than air, which will usually be present in any voids comprised in regular closures. The closure according to the present disclosure in which at least one void of the closure is filled with a gas different from air ensures that upon closure desorption a gas different from air will ingress into the product retaining container compared to closures known to the person skilled in the art. Thus, in the case of a gas comprising > about 80 vol. % nitrogen this means that upon closure desorption less oxygen will ingress into the product retaining container compared to closures known to the person skilled in the art.

According to another embodiment, the gas comprised in the at least one void of the closure can be enriched in nitrogen to a concentration of > about 90 vol. % nitrogen. In yet another embodiment, said nitrogen concentration may be > about 95 vol. % nitrogen, or > about 97.5 vol. % nitrogen or even about 100 vol. % nitrogen. The higher the concentration of nitrogen in the at least one void of the closure, the lower the amount of oxygen that ingresses into the container interior by desorption upon closure of the container.

In another embodiment of this disclosure the at least one void of the closure is filled with a gas which is defined to have an oxygen concentration lower than that of air. In particular, the oxygen concentration of said gas may be selected from the group consisting of below about 19.9 vol. %, below about 15.0 vol. %, below about 10.0 vol. %, below about 5.0 vol. %, below about 2.5 vol. % and below about 1.0 vol. %.

In another embodiment of the disclosure, the at least one void of the closure may be filled with a gas, wherein the gas comprises in addition to nitrogen at least one selected from the group consisting of an inert gas, oxygen, sulfur dioxide and carbon dioxide. In case the product retained in the container is wine, a closure wherein the gas in the voids of said closure comprises in addition to nitrogen also sulfur dioxide can be particularly useful. Sulfur dioxide is widely used in winemaking, both as a preservative and to slow oxidation. Sulfur dioxide reacts with oxygen and its oxidative derivatives such as hydrogen peroxide and thereby prevents excessive oxidation of the wine. Over time, free sulfur dioxide slowly reacts with the oxygen present in the headspace of the container and the amount of free sulfur dioxide therefore decreases over time. Enologists have proposed that it takes about 4 mg/L sulfur dioxide to reduce about 1 mg/L oxygen.

According to a further exemplary embodiment of the present disclosure, the at least one void of the closure is filled with a gas comprising sulfur dioxide. This may allow for a new means to deliver sulfur dioxide into a wine retaining container to inhibit or control oxidation of the wine. Upon closure desorption of such a closure, ingress of sulfur dioxide, which was stored in the at least one void of the closure, may help to effectively further reduce the oxygen content in the container interior. In a further exemplary embodiment the amount of sulfur dioxide present in the at least one void of the closure may be selected so that the concentration of free sulfur dioxide in the container interior after bottling is within an optimal range for the respective product retained in the container.

In another embodiment of the disclosure, the at least one void of the closure has a pressure different from standard atmospheric pressure. As used herein, "standard atmospheric pressure" is defined as 101.325 kPa (1 atm). In particular, the at least one void can have a pressure below standard atmospheric pressure. In one embodiment this is achieved by a full or partial vacuum within said at least one void. In another embodiment said at least one void is filled with a gas having a pressure different from standard atmospheric pressure, in particular below standard atmospheric pressure. If the headspace of the product retaining container is filled with air, the difference in the partial pressure between headspace and the at least one void of the closure having a pressure below standard atmospheric pressure may result in oxygen diffusing out of the container interior into the at least one void of the closure, thereby effectively further reducing the initial oxygen content in the container interior.

As described above, it is believed that a major driving force behind closure desorption is diffusion. Diffusion will likely be enhanced by the compression that the closure undergoes upon insertion into the portal of the product retaining container. The air (or any other gas or mixture of gases trapped in the closure, or dissolved, adsorbed, chemically or otherwise bonded to the closure material) is believed to diffuse out of or gas off the closure as a consequence of one or more of the following: (a) the high air pressure within the voids of the closure, (b) the difference in partial pressure compared to the container interior and exterior, and/or (c) the high pressure on the closure as a whole. The closure according to the present disclosure in which the at least one void of the closure has a pressure below standard atmospheric pressure, ensures that less closure desorption occurs upon or after bottling compared to standard closures known in the art. This is because, even as the pressure inside the voids is increased upon compression of the closure during bottling, the final air pressure in the voids of the closure is likely to be lower than in corresponding regular closures known in the art, in which before bottling, the pressure inside the voids is equal to atmospheric pressure.

However in another embodiment of the present disclosure, the at least one void of the closure can also have a pressure above standard atmospheric pressure. It has been found that such an overpressure is beneficial when it is intended to deliver a particular gas or agent into the container interior or head space via closure desorption. For example, when the at least one void is filled with a gas enriched in sulfur dioxide, delivery of sulfur dioxide into the container interior by desorption upon closure of the container will be enhanced if the at least one void will have a pressure above standard atmospheric pressure. Next to the pressure build-up due to compression of the closure upon insertion into the portal of the container, the initial overpressure in the at least one void of the closure will further enhance desorption of the gas comprised in said at least one void of the closure into the container interior. In case the at least one void of the closure is filled with a gas enriched in sulfur dioxide, this increased desorption may result in a better preservation of the product retained in the container and/or a general reduction of the oxygen content in the container interior.

In yet another exemplary embodiment of the disclosure, the closures may have an oxygen ingress rate, as measured by mg oxygen ingress in the first 100 days after closing the container, selected from the group consisting of less than 1.5 mg oxygen, less than 1.25 mg oxygen, less than 1.0 mg oxygen, less than 0.5 mg oxygen, less than 0.2 mg oxygen and less than 0.1 mg oxygen per container, in the first 100 days after closing the container. Such well defined oxygen ingress rates for closures can be achieved by the teaching of the present disclosure, in particular by providing closures comprising at least one void, wherein at least one void is filled at least partially with a gas comprising nitrogen in a concentration selected from the group consisting of > about 80.0 vol. % nitrogen, > about 90.0 vol. % nitrogen, > about 95.0 vol. % nitrogen, > about 97.5 vol. % nitrogen and about 100.0 vol. % nitrogen and/or a gas comprising oxygen in a concentration selected from the group consisting of < about 19.9 vol. % oxygen, < about 15.0 vol. % oxygen, < about 10.0 vol. % oxygen, < about 5.0 vol. % oxygen, < about 2.5 vol. % oxygen and < about 1.0 vol. % oxygen.

Figure 4:
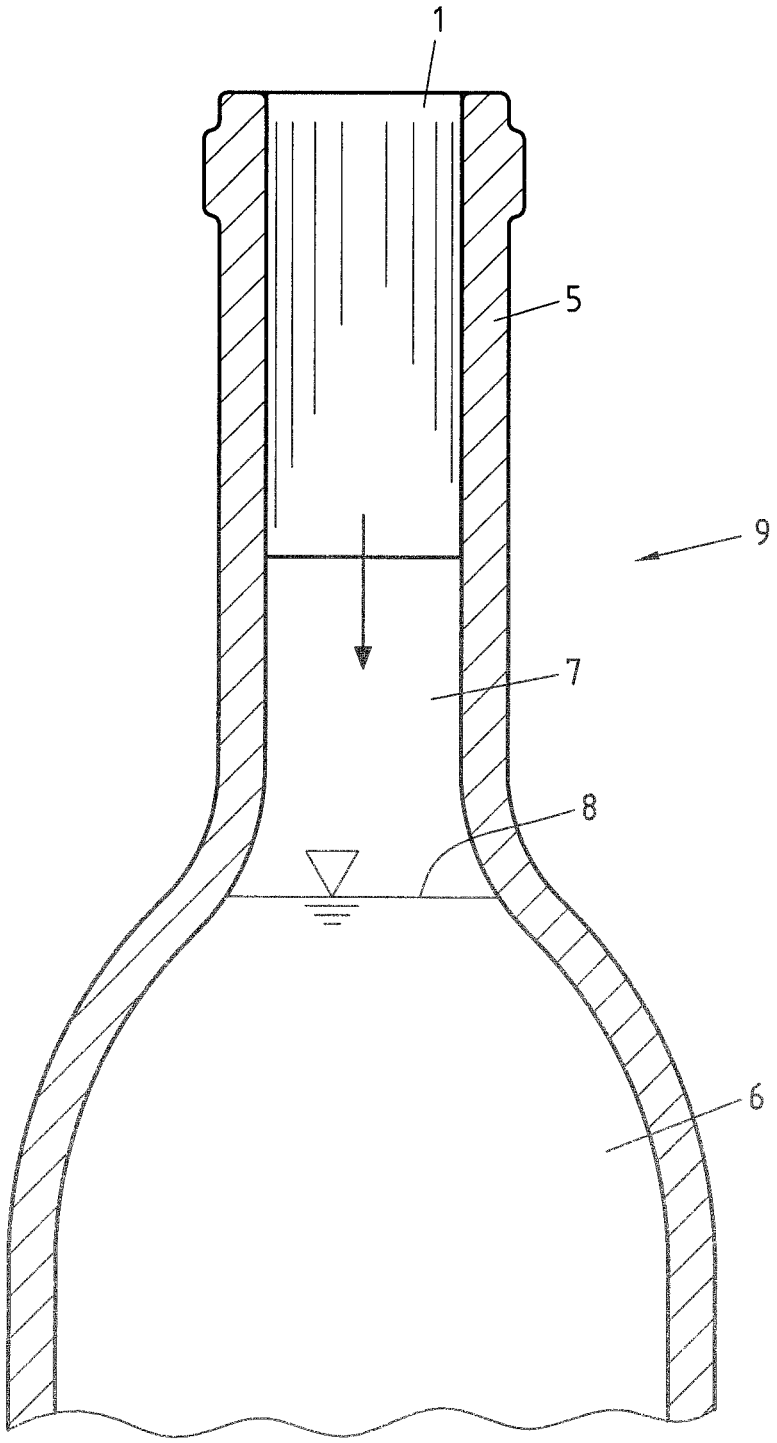
FIG. 4 is an exploded schematic view of a first exemplary embodiment of a closure system according to one embodiment of the present disclosure.

In another exemplary embodiment, the container is a bottle. Referring now to FIG. 4, a closure system 9 comprising a closure 1 inserted into and sealing closed a product retaining container 5 is illustrated. In this embodiment the retained product 6 may be a liquid, in particular wine. The head space 7 is the ullage volume between the fill level 8 and the flat terminating end of the closure 1 facing the bottle interior.

Methods to precisely measure oxygen ingress into a closed container are known to the person skilled in the art. For example, the Mocon® Ox-tran® method (Mocon Inc., Minneapolis, USA) is widely applied and recommended in different standards such as the ASTM (F1307-02). A very convenient method for measuring oxygen ingress according to the present disclosure is by a non-destructive technique known as Nomasense® technology. This method allows measurement of oxygen ingress through the closure by luminescence-based technology using separate sensors supplied by PreSens® (Precision Sensing GmbH, Regensburg, Germany). Detailed description of oxygen measurement technologies and protocols can be found, for example, in (Dieval J-B., Vidal S. and Aagaard O., *Packag. Technol. Sci.* 2011; DOI: 10.1002/pts.945). However, independent of the measuring method used to determine the oxygen concentration in the bottle head space or interior, the term oxygen ingress used throughout this disclosure shall mean the difference between the oxygen concentration measured in the container interior directly after closing and that measured at a later point in time. Of course, measurement of oxygen ingress may be strongly influenced by the oxygen concentration of the surrounding atmosphere in which the bottles or containers are stored and in which the measurement is performed. If not otherwise stated, total oxygen ingress and oxygen ingress rate as used herein are determined using an atmosphere having an oxygen concentration of 20%. If not otherwise stated, desorption as stated herein is measured under standard atmospheric conditions (20° C. and 1 atm) and 20% oxygen, whereas OTR values are measured under 100% oxygen.

Another useful parameter to define the closures of the present disclosure is the total amount of desorption they show upon closing of the container. As described above, total oxygen ingress at a given time point can be defined as the sum of desorption upon and in the period following closing of the container (several weeks to one year, depending on the rate of diffusion) and the steady-state linear oxygen transfer rate (OTR) later on. Curves depicting oxygen ingress into a container through closures can be divided into a first non-linear part, here called desorption, and a second linear part, the slope of which is the OTR. Whereas means to control closure OTR are known in the art, the present disclosure allows for controlling closure desorption. Desorption is the amount of gas entrapped in the closure itself and entering the container after it has been closed with the closure. Without being bound by scientific theory, it is believed that desorption occurs via diffusion. The present inventors have found that the total amount of desorption and the time for desorption to occur differs depending on the type of closure analyzed. This might be explained by the fact that diffusion in a closure is dependent on the ability of the closure to limit gas mobility. The quantity of desorption has also been found to depend on the compression of the closure, the bottle bore variation, the dimensions of the closure, and the quantity of gas present in the closure. This will again be influenced by the porosity (basically definable as 1-density) of the closure, and solubility of the gas in the closure material.

Only recently, mathematical modeling has allowed describing the oxygen ingress curve for container closures in mathematical terms (Dieval J-B., Vidal S. and Aagaard O., *Packag. Technol. Sci.* 2011; DOI: 10.1002/pts.945). Without being bound by scientific theory, the authors believe that this publication provides a substantially quantitative description of oxygen ingress and desorption of closures for product retaining containers. According to this publication, which is incorporated by reference in its entirety, oxygen ingress Qt can be described by the following equation:

$$Qt = \frac{D \cdot S \cdot (p_1^- p_2) \cdot t}{L} + \frac{2 \cdot L \cdot S}{\pi^2} \sum_{m=1}^{\infty} \frac{p_1 \cdot \cos m\pi^- p_2}{m^2} \{1 - \exp(-Dm^2\pi^2 t / L^2)\} + \tag{1}$$

-continued $$\frac{4 \cdot p_0 \cdot LS}{\pi^2} \sum_{n=0}^{\infty} \frac{1}{(2n+1)^2} \{1 - \exp(-D(2n+1)^2\pi^2 t / L^2)\}$$

where D is the diffusion coefficient in $cm^2/s$, S the solubility in $cm^3$ $(O_2)/cm^3$ (closure)/atm, $p_1$, $p_2$ and $p_0$ the pressures in atm, L the length of the closure in cm and t the time in days. Qt is thus expressed in $cm^3(O_2)/cm^2$, can however be easily converted to hPa by equation:

$$P_{O_2} = Qt \cdot a \cdot P_{atm} / V \tag{2}$$

where $P_{O2}$ is the partial pressure of oxygen measured in the bottle in hPa, a is the surface of the closure at the lower face (x=L) expressed in $cm^2$, V is the volume of the bottle in $cm^3$ and $P_{atm}$ is the atmospheric pressure during the experiment in hPa. The other parameters of the above equations are defined as follows: the exchange surface "a" shall be calculated from the volume of the neck and the length of the closure measured for each container:

$$a = V_N / L \tag{3}$$

$S_{app}$ is to be estimated as the porosity:

$$S_{app} = \varphi = 1 - d/\rho \tag{4}$$

where φ is the porosity, d the density of the closure and ρ the density of the closure material. The density of the closure d is to be calculated from the weight w of the closure and the volume of the closure in the neck $V_N$:

$$d = w / V_N \tag{5}$$

The pressure $p_0$ in the closure at t=0 must be calculated because it corresponds to the pressure of oxygen in the closure when the closure is compressed in the neck. Applying the principle of mass conservation $$P_O * V_{airneck} = P_{air} * V_{airclosure} \tag{6}$$

where $V_{airneck}$ is the volume of air in the closure compressed in the neck, $P_{air}$ the pressure of oxygen when the closure was stored in air (0.209 atm) and $V_{airclosure}$ the volume of air in the closure before corking. $V_{airclosure}$ and $V_{airneck}$ have to be calculated from the volume of the closure ($V_c$) and the volume of the neck ($V_N$), respectively. From these, the volume occupied by the closure material (w/ρ) has to be subtracted.

$$P_O = P_{air} * (V_c - w/\rho) / \{V_N - w\} / \rho \tag{7}$$

where $V_c$ is the volume of the closure, calculated from length L and diameter d.

$$V_c = \pi * L * (d/2)^2 \tag{8}$$

D remains the variable to be calculated when fitting the transformed equation to the experimental data. Data are best analyzed using an XLfit model editor (IDBS, Guilford, Surrey, UK). When measuring closure oxygen ingress rates or desorption, the intrinsic parameters for each closure must be defined. The diffusion coefficient D varies until the system reaches the best fit to the experimental data. For each set of experimental data, the respective diffusion coefficient is automatically generated by the software. The corresponding OTR value (calculated for 100% oxygen outside) can then be calculated as:

$$OTR = (1013/P_{atm}) * D \cdot S_{app} \cdot a / L \tag{9}$$

In another embodiment of the disclosure, the closures are defined to have a total amount of desorption after closing the container selected from the group consisting of less than about 2.0 mg oxygen, less than about 1.5 mg oxygen, less than about 1.25 mg oxygen, less than about 1.0 mg oxygen, less than about 0.5 mg oxygen, less than about 0.2 mg oxygen and less than about 0.1 mg oxygen. Desorption as used herein is mathematically described in the third summand of equation 1, where the total amount of desorption is given by $$\frac{4 \cdot p_0 \cdot LS}{\pi^2} \tag{10}$$

The amount of desorption in milligrams is calculated by multiplying equation (10) with $a \cdot M_{ox}/V_{mol}$, wherein a is the surface of the flat terminating end of the closure in $cm^2$; $M_{ox}$ is the molar mass of oxygen (32 mg/mmol) and $V_{mol}$ is the molar volume, i.e. the volume of 1 mol of gas at a certain temperature and pressure. If one e.g. assumes the gas to be an ideal gas, $V_{mol}$ is 24.79 $cm^3$/mmol at 25° C. and 1 bar. The kinetics of desorption is given by $$\sum_{n=0}^{\infty} \frac{1}{(2n+1)^2}\{1 - \exp(-D(2n+1)^2\pi^2 t/L^2)\} \tag{11}$$

Closures having a total amount of desorption of less than 0.5 mg oxygen, less than 0.2 mg oxygen and/or less than 0.1 mg oxygen are believed to be particularly useful for preventing excessive oxidation of the material, e.g. wine, stored in the container interior. In a particular embodiment, the oxygen ingress measured 100 days after closing the container is less than about 0.5 mg oxygen, or less than about 0.2 mg oxygen. In a particular embodiment the container is a bottle. In another embodiment of the disclosure, closures having total amounts of desorption close to zero mg oxygen have been found to be beneficial for ensuring minimal and/or very well controlled oxygen ingress rates, as then the oxygen ingress rate will be determined by OTR only. In contrast to desorption, OTR is a closure parameter, which already can be controlled by state of the art closure production technology. Moreover, reducing desorption to a minimum ensures that oxygen ingresses into the container interior in a slow but constant OTR and not abruptly in a non-linear fashion as in closure desorption upon closing of the container.

To further counteract the initially high oxygen concentration in containers after closing of said containers, which can lead to uncontrolled oxidation of the content stored in the container, a closure according to this disclosure may further comprise at least one oxygen scavenging agent. Said oxygen scavenging agent can effectively antagonize and decrease the initially high oxygen concentration immediately after bottling. During longer term bottle storage, if desired, a suitably high closure OTR would nonetheless ensure a defined amount of oxygen to consistently enter the container interior over a defined period of time.

In a particular embodiment of the disclosure, oxygen scavengers are comprised in closures described above, wherein the at least one void of the closure has a pressure below standard atmospheric pressure, in particular a full or partial vacuum. Without being bound by scientific theory, it is believed that due to the difference in partial pressure, desorption with these closures will be inhibited and instead oxygen from the container head space will in fact diffuse into the at least one void of the closure. To effectively bind the oxygen in the closure and prevent it from reentering the container, it may be beneficial if the closure comprises in addition at least one oxygen scavenging agent.

In a further embodiment, the oxygen scavenging agent could also be used to antagonize and fine-tune the amount of oxygen present in the bottle, which may have been initially released by desorption or may have passively permeated through the bottle closure by closure OTR. The oxygen scavenging agent may also prevent OTR by directly scavenging the oxygen diffusing through the closure.

Oxygen scavenging agents may be contained in an element of the closure selected from the group consisting of the element of the closure comprising the at least one void, the entire closure, an area defining part of the closure, a seal or liner that can be fitted between container head space and the remainder of the closure and a layer defining part of said liner.

According to other embodiments disclosed herein, the oxygen scavenger agent is selected from the group consisting of ascorbates, sulfites, EDTA, hydroquinone, iron or other metallic active species, tannins and their salts and precursors, and combinations thereof. Oxygen scavenging additives are known in the art and are commercially available, for example, under the tradename Shelfplus O2® from Ciba AG at Basel (CH). In a particular embodiment, the oxygen scavenger agent is selected from the group consisting of sodium ascorbate, sodium sulfite and potassium EDTA, iron or other metal based scavengers, and combinations thereof. Specific examples are oxygen scavengers selected from the group consisting of Trastab OS 8020 (Tramaco), Darex MB 2002 (Grace-Davison), CESA-absorb (Clariant), CESA-absorb PEA0050857 (Clariant) and CESA-absorb PEA0050919 (Clariant), or combinations thereof.

Next to closure desorption, the other critical parameter determining oxygen ingress through closures is the closure OTR. According to another embodiment of the present disclosure, the closures have an oxygen transfer rate in axial direction as determined by Mocon® or Nomasense® measurement using 100 vol. % oxygen from about 0.0001 to about 0.1000 cc/day/closure, in particular from about 0.0005 to about 0.050 cc/day/closure.

In one embodiment of the present disclosure the closure is made partly or completely from natural cork. Examples of such closures comprising natural cork are full-natural, technical, agglomerated or micro-agglomerated cork closures. Referring now to FIGS. 3*a* and 3*b*, in such a closure 1 comprising natural cork material the at least one void 4 as used herein can be the cells, lenticels, passages and inclusions present in natural cork.

In another embodiment of the present disclosure the closure is a synthetic closure. Regardless of its shape, composition and structure, synthetic closures comprising one or more thermoplastic polymers are particularly useful. The thermoplastic polymer can be selected from the group consisting of polyethylenes, metallocene catalyst polyethylenes, polybutanes, polybutylenes, polyurethanes, silicones, vinyl/based resins, thermoplastic elastomers, styrene block copolymers, polyesters, ethylenic acrylic copolymers, ethylene-vinyl-acetate copolymers, ethylene-methyl-acrylate copolymers, thermoplastic polyurethanes, thermoplastic olefins, thermoplastic vulcanizates, flexible polyolefins, fluoroelastomers, fluoropolymers, polyethylenes, polytetrafluoroethylenes, and blends thereof, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers, ionomers, polypropylenes, and copolymers of polypropylene and copolymerizable ethylenically unsaturated comonomers, olefin block polymers, and mixtures thereof.

In another embodiment of the disclosure, the closure has a density from about 100 kg/m$^3$ to about 800 kg/m$^3$, in particular from about 200 kg/m$^3$ to about 500 kg/m$^3$.

In a particular embodiment, the closure is a cylindrically shaped synthetic closure for wine bottles, which can be manufactured by various methods known to the person skilled in the art such as, for example, injection molding, mono-extrusion, co-extrusion and/or cross-head extrusion. According to another exemplary embodiment of the disclosure, the closure or the thermoplastic polymer comprised therein is wholly or partially foamed. In a particular embodiment of the disclosure the foamed material is further defined as being substantially closed cell foam. In such cases, the cells of the foamed material make up the at least one void according to the present disclosure. Accordingly, the at least one void may be further defined as being the space inside the plurality of cells of the wholly or partially foamed closure. In particular, the foam can have a cell size characterized by a range of between about 0.025 mm and about 0.5 mm, in particular between about 0.05 mm to about 0.35 mm. On the other hand, it should be appreciated that the underlying idea of the present disclosure can be applied to unfoamed closures as well, as long as they comprise at least one void.

In another embodiment of the present disclosure, the closure is of a substantially cylindrical shape and comprises substantially flat terminating surfaces forming the opposed ends of said closure.

Furthermore, the synthetic closure of the present disclosure may have a layered structure, i.e. it can, for example, comprise a foamed core member and a peripheral layer cylindrically enveloping the core member. It should be noted, however, that the synthetic closure of the present disclosure may also comprise only one single component (e.g. a foamed, partially foamed or unfoamed cylindrically shaped body made from thermoplastic material) without any additional layers.

According to one embodiment of the disclosure, the closure comprises an elongated, cylindrically shaped core member formed from foamed plastic material and comprising terminating end surfaces forming the opposed ends of the cylindrically shaped core member; and at least one layer peripherally surrounding and intimately bonded to the cylindrical surface of the core member with the end surfaces of the core member being devoid of said layer, and whereby a synthetic closure is attained which is capable of completely sealing any desired product in a container, retaining the product in the container for a desired length of time substantially without any degradation of the product or degradation of the closure.

According to another embodiment of the disclosure, the synthetic bottle closure of the present disclosure comprises, as its principal component, a core member which is formed from extruded, foamed, plastic polymers, copolymers, or homopolymers, or blends thereof. In such closure, the at least one void according to the present disclosure is further defined as being the space inside the plurality of cells of the foamed core member. Although any known foamable plastic material can be employed in the extrusion process for developing the bottle closure of the present disclosure, the plastic material must be selected for producing physical properties similar to natural cork, so as to be capable of providing a synthetic closure for replacing natural cork as a closure for wine bottles. By way of example, the plastic material for the core member can be a closed cell plastic material. Suitable plastic materials for the core member are, for example, polyethylenes, metallocene catalyst polyethylenes, polybutanes, polybutylenes, polyurethanes, silicones, vinyl-based resins, thermoplastic elastomers, polyesters, ethylenic acrylic copolymers, ethylene-vinyl-acetate copolymers, ethylene-methyl-acrylate copolymers, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers of polypropylene, copolymerizable ethylenically unsaturated commoners and/or mixtures thereof. Particularly useful plastic materials for the core element can be polyethylene, in particular LDPE, and/or ethylene-vinyl-acetate copolymer (EVA).

In yet another embodiment of the present disclosure, the core member further comprises a fatty acid derivative or mixtures thereof. Examples of fatty acid derivatives according to the present disclosure are fatty acid esters or a fatty acid amides such as a stearamides. In fact, the inventors of the present disclosure have found that the addition of at least one fatty acid derivative to the polymer composition of the synthetic closure imparts superior properties to the synthetic closure. In particular, it was found that the oxygen transfer rate of the closure can be reduced substantially, thus further reducing unwanted oxidation of wine. In addition, it was found that the use of a fatty acid derivative additive does not have a negative impact on the performance characteristics of synthetic corks such as extraction force, ovality control, diameter control and length control. In order to impart the desired OTR reducing effect to the closure, the fatty acid derivative is typically used in a concentration from about 0.01 to about 10 wt. %, in particular from about 0.1 to about 5 wt. %, more particularly from about 1 to about 3 wt. %, based on the total weight of thermoplastic polymer.

In a further exemplary embodiment of the disclosure, the density of the core member in the final product is between about 100 to about 500 kg/m$^3$, in particular between about 200 to about 350 kg/m$^3$ or between about 250 to about 420 kg/m$^3$. By way of example, the cell size of the core member in the final product can be substantially homogeneous throughout its entire length and diameter.

In another embodiment of the disclosure the core member is defined to comprise closed cells having an average cell size ranging from between about 0.02 mm to about 0.50 mm, in particular between about 0.05 mm and 0.1 mm and/or a cell density ranging between about 8,000 cells/cm$^3$ to about 25,000,000 cells/cm$^3$, in particular between about 1,000,000 cells/cm$^3$ to about 8,000,000 cells/cm$^3$. The at least one void according to the present disclosure may then be defined to be the plurality of cells comprised in said core member.

In order to control the cell size of core member and attain the desired cell size detailed above, a nucleating agent can be employed. In a particular embodiment, it has been found that by employing a nucleating agent selected from the group consisting of calcium silicate, talc, clay, titanium oxide, silica, barium sulfate, diatomaceous earth, and mixtures of citric acid and sodium bicarbonate, the desired cell density and cell size is achieved.

As is well known in the industry, a blowing agent can be employed in forming extruded foam plastic material. In the present disclosure, a variety of blowing agents can be employed during the extruded foaming process whereby core member is produced. Typically, either physical blowing agents or chemical blowing agents are employed. Suitable blowing agents that have been found to be efficacious in producing the core member of the present disclosure comprise one or more selected from the group consisting of: aliphatic hydrocarbons having 1-9 carbon atoms, halogenated aliphatic hydrocarbons having 1-9 carbon atoms and aliphatic alcohols having 1-3 carbon atoms. Aliphatic hydrocarbons include methane, ethane, propane, n-butane, isobutane, n-pentane, isopentane, neopentane, and the like. Among halogenated hydrocarbons and fluorinated hydrocarbons they include, for example, methylfluoride, perfluoromethane, ethyl fluoride, 1,1-difluoroethane (HFC-152a), 1,1,1-trifluoroethane (HFC-430a), 1,1,1,2-tetrafluoroethane (HFC-134a), pentafluoroethane, perfluoroethane, 2,2-difluoropropane, 1,1,1-trifluoropropane, perfluoropropane, perfluorobutane, perfluorocyclobutane. Partially hydrogenated chlorocarbon and chlorofluorocarbons for use in this disclosure include methyl chloride, methylene chloride, ethyl chloride, 1,1,1-trichlorethane, 1,1-dichlorol-fluoroethane (HCFC-141b), 1-chloro1,1-difluoroethane (HCFC-142b), 1,1-dichloro-2,2,2-trifluoroethane (HCFC-123) and 1-chloro-1,2,2,2-tetrafluoroethane (HCFC-124). Fully halogenated chlorofluorocarbons include trichloromonofluoromenthane (CFC11), dichlorodifluoromenthane (CFC-12), trichlorotrifluoroethane (CFC-113), dichlorotetrafluoroethane (CFC-114), chloroheptafluoropropane, and dichlorohexafluoropropane. Fully halogenated chlorofluorocarbons are not preferred due to their ozone depiction potential. Aliphatic alcohols include methanol, ethanol, n-propanol and isopropanol. Chemical blowing agents include azodicarbonamic, azodiisobutyro-nitride, benzenesulfonhydrazide, 4,4-oxybenzene sulfonylsemicarbazide, p-toluene sulfonylsemicarbazide, barium azodicarboxlyate, N,N'-Dimethyl-N,N'-dinitrosoterephthalamide, trihydrazinotriazine, and hydrocerol.

In a particular embodiment, inorganic (or physical) blowing agents are used in making the foamed material of the present disclosure. Examples of inorganic blowing agents include carbon dioxide, water, air, helium, nitrogen and argon. Carbon dioxide is a particularly useful blowing agent.

According to another exemplary embodiment, in order to produce the desired product, the blowing agent may be incorporated into the plastic melt in a quantity ranging between about 0.005% to about 10% by weight of the weight of the plastic material.

Depending upon the sealing process employed for inserting the synthetic closure of the present disclosure in a desired bottle, additives, such as slip additives, may be incorporated into the outer, peripherally surrounding layer of the synthetic closure of the present disclosure to provide lubrication of the synthetic closure during the insertion process. In addition, other additives typically employed in the bottling industry may also be incorporated into the synthetic closure of the present disclosure for improving the sealing engagement of the synthetic closure with the bottle as well as reducing the extraction forces necessary to remove the synthetic closure from the bottle for opening the bottle.

According to one embodiment of the present disclosure, a unique synthetic bottle closure is realized by forming an outer layer peripherally surrounding the core member in intimate, bonded, interengagement therewith. Due to the operation of the cooperating jaws which are employed to compress the stopper for insertion into the bottle, sharp edges of the jaw members are forced into intimate contact with the outer surface of the stopper. Although cork material has been successful in resisting permanent damage from the jaw edges in most instances, other prior art synthetic stoppers have been incapable of resisting these cutting forces. As a result, longitudinal cuts, score lines or slits are formed in the outer surface of the stopper, enabling liquid to seep from the interior to the exterior of the bottle. This inherent problem, existing with prior art cork and synthetic closures, can be eliminated by incorporating peripheral layer which surrounds and envelopes envelops substantially the entire outer surface of core member. In addition, by forming peripheral layer from high density, rugged, score-resistant material, synthetic bottle closure overcomes all of the prior art difficulties and achieves a bottle closure having physical properties equal to or superior to conventional cork material.

In one embodiment of the present disclosure, the outer peripheral layer of the synthetic closure is formed from foam or non-foam plastic material. However, the outer peripherally surrounding layer is formed with a substantially greater density in order to impart desired physical characteristics to the synthetic bottle closure of the present disclosure. In particular embodiments of the present disclosure, the peripheral layer is formed from one or more of the following plastic materials: thermoplastic polyurethanes, thermoplastic olefins, thermoplastic vulcanizates, flexible polyolefins, fluoroelastomers, fluoropolymers, polyethylenes, styrene butadiene block copolymers, thermoplastic elastomers, polyether-type polyurethanes and/or mixtures or blends thereof. Particular examples of the plastic material for the peripheral layer are polypropylene, EPDM rubber, and/or polystyrene. If desired, the peripheral layer can be formed from a transparent plastic material. Furthermore, the plastic material selected for the peripheral layer may be different from that of the core member. In particular, the density of the peripheral layer in the final product can be from about 300 to about 1500 kg/m$^3$, in particular about 505 to about 1250 kg/m$^3$ and/or about 750 to about 1100 kg/m$^3$. The thickness of said peripheral layer can comprise a thickness ranging between about 0.05 mm and about 5 mm, and in particular between about 0.1 mm and about 2 mm.

It has also been discovered that further additional additives may be incorporated into either core member and/or outer layer of the synthetic closure according to the present disclosure in order to provide further enhancements and desirable performance characteristics. These additional additives incorporate antimicrobial agents, antibacterial compounds, and or oxygen scavenging materials. Suitable oxygen scavenging additives are described above. The antimicrobial and antibacterial additives can be incorporated into the closure to impart an additional degree of confidence that in the presence of a liquid the potential for microbial or bacterial growth is extremely remote. These additives have a long term time release ability and further increase the shelf life without further treatments by those involved with the bottling of wine.

The closure can be manufactured by methods known to the person skilled in the art. In accordance with a particular embodiment of the present disclosure, a continuous manufacturing operation is provided wherein the core member of the synthetic closure is formed by a continuous extrusion process which enables the core to be manufactured as an elongated, continuous length of material.

As described above, in accordance with the present disclosure, an outer layer or skin surface can be formed about the central core. In this way, the elongated length of material is produced in a continuous production operation enabling all production steps to be completed prior to the formation of the individual synthetic closure members by cutting the elongated length of extruded material in the desired manner.

In addition, the closures of the present disclosure may also comprise decorative indicia such as letters, symbols, colors, graphics, and wood tones printed on the outer layer and/or one of the substantially flat terminating surfaces forming the opposed ends of said closure or stopper. Printing of these indicia can be performed in-line, during production of the closure or in a separate step after the closure has been manufactured.

By achieving a synthetic closure in accordance with the present disclosure, a bottle closure is realized which is capable of satisfying all requirements imposed thereon by the wine industry, as well as any other bottle closure/packaging industry. As a result, a synthetic bottle closure is attained that can be employed for completely sealing and closing a desired bottle for securely and safely storing the product retained therein, optionally with desired markings and/or indicia printed thereon.

In the prior art, it has been standard to manufacture closures in the open air and under ambient pressure. Thus closures of the prior art that were used for sealing closed a container, were equilibrated in air and therefore any voids comprised in closures of the prior art are filled with air. However, such closures show desorption of oxygen into the container, which can result in premature oxidation and spoilage of the material, e.g. wine, retained in the container. In this regard the present disclosure further provides a use of a closure for sealing closed a container, wherein said closure comprises at least one void and wherein said void is at least partially filled with a gas different from air and/or wherein said gas has a pressure different from standard atmospheric pressure. Such use ensures that upon closure desorption a gas different from air, in particular comprising less oxygen will ingress into the product retaining container compared to closures known to the person skilled in the art.

In a particular embodiment of this disclosure, closures are employed in the aforementioned use, which have an oxygen ingress rate of less than about 1 mg oxygen per container in the first 100 days after closing the container. By way of example, the oxygen ingress rate may be selected from the group consisting of less than about 0.5 mg oxygen, less than about 0.25 mg oxygen, less than about 0.2 mg oxygen and less than about 0.1 mg oxygen, per container in the first 100 days after closing the container.

It has been found to be beneficial if the at least one void is filled with a gas having an oxygen concentration selected from the group consisting of below about 19.9 vol. %, below about 15.0 vol. %, below about 10.0 vol. %, below about 5.0 vol. %, below about 2.5 vol. % and below about 1.0 vol. %. Such use of a closure may minimize the amount of oxygen ingress into the product retaining container compared to using closures known to the person skilled in the art.

The present disclosure also provides the use of any of the closures described above for sealing closed a container, wherein said closure comprises at least one void and wherein said void is at least partially filled with a gas different from air and/or wherein said gas has a pressure different from standard atmospheric pressure. Such use may overcome many of the shortcomings of the prior art. In particular, the amount and rate of desorption and thus the amount and kinetics of oxygen ingress into the container interior can be closely controlled and if desired minimized.

The present disclosure also provides a method for producing a closure for a product retaining container, wherein said closure comprises at least one void and the method comprises the step of introducing into said at least one void a gas which by composition is different from air and/or changing the pressure in said at least one void to a pressure different from standard atmospheric pressure. Said gas may be introduced into said at least one void during the production of the basic closure, one of its components or alternatively in a separate step after the basic closure has been produced.

The expression "introducing a gas into a void" as used herein means that the gas composition of a void, which is pre-existing or may have been created in a prior production step, is changed to or exchanged for a gas or mixture of gases, which according to the disclosure is different from air. What is not meant by the expression "introducing a gas into a void" as used herein is the creation of voids by using e.g. a gaseous blowing agent.

In particular, the gas to be introduced into the at least one void of the closure can have an oxygen concentration selected from the group consisting of below about 19.9 vol. %, below about 15.0 vol. %, below about 10.0 vol. %, below about 5.0 vol. %, below about 2.5 vol. % and below about 1.0 vol. %. In another embodiment, the gas may comprise a nitrogen concentration of > about 80 vol. % nitrogen. The gas used in the method for producing the closure may be as described above in detail for the gas which is comprised in the at least one void of the closure according to the present disclosure.

It has been found that the gas can conveniently be introduced into the at least one void by diffusion. By way of example, such diffusion can take place by incubating and/or storing the closure in an environment comprising the gas which is to be introduced into the at least one void of said closure. In a particular embodiment the closure is stored in a sealed compartment comprising an atmosphere which by composition and/or pressure is different from air. For diffusion to take place, there needs to be a difference in gas composition between the interior of the at least one void of the closure and the outside atmosphere or environment in which the closure is placed for introducing the gas into the at least one void of the closure. According to the concentration gradient and difference in partial pressure, the interior of the at least one void of the closure will equilibrate with the outside atmosphere or environment in which the closure is placed. As the space in the at least one void will in most cases be infinitesimally smaller than the total outside atmosphere, the gas composition making up the outside atmosphere will effectively be introduced into the at least one void of the closure. The diffusion process to introduce a gas into the at least one void of the closure may be accelerated by placing the gas in the outside atmosphere under high pressure, which will be an additional force driving the gas into the at least one void of the closure by diffusion.

Similarly, if it is desired to introduce a gas having a pressure different from standard atmospheric pressure into the at least one void of the closure, it has been found that this can be achieved by incubating the closure in an environment having a pressure different from standard atmospheric pressure.

As used herein "environment" or "outside atmosphere" in which the closure is incubated according to the present disclosure may be a closed room or any other sealed compartment, such as a box or a bag, in which a gas composition different from air and/or a pressure different from standard atmospheric pressure can be set and maintained.

According to one embodiment of the present disclosure the basic closure is produced in a first step and then in a subsequent step a gas which by composition is different from air or the pressure of which is different from standard atmospheric pressure is introduced into the at least one void of the preformed closure.

According to another embodiment of the present disclosure the gas is introduced into the at least one void by manufacturing the closure under an atmosphere comprising the gas that is to be introduced into said at least one void. In such a case it is believed, that already during the manufacture of the closure, the interior of the at least one void of the closure will equilibrate with the outside atmosphere or environment in which the closure is manufactured. In a particular embodiment of the disclosure, the closure is manufactured in an atmosphere which by composition and/or pressure is different from air.

Of course, it is possible according to the present disclosure to combine the two methods of introducing a gas into the at least one void of a closure by diffusion, wherein the closure will first be manufactured in and subsequently stored or incubated in an atmosphere or environment comprising the gas that is to be introduced into said at least one void.

The present disclosure also provides methods to prevent closures from equilibrating in air after their production. By such methods one can achieve that the at least one void of the closure is filled with a gas different from air and that this gas composition in the at least one void is maintained until the closure is used for sealing closed a container.

For synthetic closures formed by extrusion, it is possible to place the entire extrusion equipment into a closed room or any other sealed compartment containing a gas or gaseous mixture which by composition is different from air or which has a pressure different from standard atmospheric pressure. In this way, the closures are manufactured under an environment different from air or standard atmospheric pressure. In particular, the atmosphere or gas or gaseous mixture the closures are extruded in can be a full or partial vacuum, nitrogen or a gas enriched in nitrogen to a concentration of > about 80 vol. % or > about 90 vol. % nitrogen. In another embodiment, said nitrogen concentration is > about 95.0 vol. % nitrogen, > about 97.5 vol. % nitrogen or even about 100 vol. % nitrogen. According to another embodiment, the product of the extrusion step is immediately packaged in a sealed compartment or barrier bag comprising a gas or atmosphere different from air or standard atmospheric pressure. In particular, the extruded closures or closure precursors may be extruded directly into such a compartment or barrier bag. It has been found that by performing this method, equilibration of the closures with air can effectively be prevented and the closures instead equilibrate with the atmosphere or environment present in the sealed compartment or barrier bag they are manufactured in or incubated or stored in. In a particular embodiment, the atmosphere or environment present in the sealed compartment or bather bag is selected from the group consisting of a full or partial vacuum, nitrogen and a gas enriched in nitrogen to a concentration of > about 80 vol. % nitrogen, or combinations thereof. In yet another exemplary embodiment, the nitrogen concentration is > about 90.0 vol. % nitrogen or > about 95.0 vol. % nitrogen in particular > about 97.5 vol. % nitrogen or about 100 vol. % nitrogen.

If production of the closures requires multiple steps, such as separate extrusion of outer layers of the closures or finishing of the closures by cutting, beveling, embossing or printing on the closures, these steps can be performed before, after or during incubation or storing of the closures in an atmosphere or environment comprising the gas that is to be introduced into the at least one void of the closure. In particular, this disclosure provides a method, wherein the products of the first steps of closure manufacture (called closure precursors herein) are produced into and/or stored in a sealed compartment or barrier bag comprising a gas or atmosphere different from air or standard atmospheric pressure. For performing the subsequent production steps, such as separate extrusion of outer layers of the closures or finishing of the closures by cutting, beveling, embossing or printing on the closures, the closure precursors are removed from the sealed compartment or barrier bag for the subsequent production steps to be performed. Afterwards, the finished closures are again stored, incubated or shipped in a sealed compartment or barrier bag comprising a gas or atmosphere different from air or standard atmospheric pressure. According to one embodiment of the disclosure, the sealed compartment or barrier bag for the precursor closures may accommodate between about 1,000 and about 100,000 closure precursors, in particular between about 5,000 and about 35,000 closure precursors. In a particular embodiment, the sealed compartment or barrier bag for the precursor closures is of sufficient size to accommodate about 25,000 closure precursors. According to yet another embodiment of the disclosure, the sealed compartment or barrier bag for storing, incubating or shipping the finished closures is smaller than the sealed compartment or barrier bag in which the closure precursors were stored before finishing. In particular, the sealed compartment or barrier bag for storing, incubating or shipping the finished closures is of a size that can accommodate between about 100 and about 5,000 closure, in particular between about 500 and about 2,500 closures. In a particular embodiment, the sealed compartment or barrier bag for the finished closures is of sufficient size to accommodate about 1,000 closures.

The closures described in the present disclosure with the particular gas composition and/or pressure in the at least one void of the closure are meant to be ready-to-use to be employed in sealing closed a product retaining container. It has been found that when closures according to the present disclosure are shipped or stored in sealed compartments or barrier bags described herein, they substantially maintain the gas composition within the at least one void of the closure for up to 24 hours after being removed from the barrier bag. Therefore, if barrier bags are opened, the closures present therein can be used for sealing closed containers according to the present disclosure within the same day that the barrier bag was open, without the gas composition in the at least one void of the closure being substantially changed.

As used herein "barrier bag" is a type of compartment that provides a substantially airtight seal. Such barrier bags are known to the person skilled in the art. They are usually employed to prevent oxygen from entering the interior of the barrier bag thereby protecting the products retained in the bag from unwanted oxidation. According to the present disclosure it has been found that such barrier bags are particularly useful to incubate, store or ship closures of the present disclosure under an atmosphere that is different from air or a pressure that is different from atmospheric pressure. The barrier bags according to certain embodiments of the present disclosure prevent gas exchange with the outside environment in general. In particular they maintain the gas atmosphere or pressure present in the barrier bag upon closing over an extended period of time.

In one embodiment of the disclosure, the barrier bag is substantially made of polymeric film and said film is selected from the group consisting of Nylon, EVOH, saran, saranex, metallized polyester, metallized nylon, PVDC, biaxially-oriented polyethylene terephthalate and Mylar, or combinations thereof. In one embodiment of the disclosure, the barrier bag is substantially made of aluminum foil. However, it is to be understood that the barrier bag according to the present disclosure can be composed of any material that is capable of providing the desired characteristics such as the provision of an airtight seal.

According to yet another embodiment of the present disclosure, the barrier bag comprises one layer comprising at least one oxygen scavenging agent. Suitable oxygen scavenging agent are known to the person skilled in the art and described above. In another embodiment, the barrier bag comprises an oxygen-scavenging sachet or packet. This sachet or packet can for example be affixed to the inside of the barrier bag. By providing barrier bags comprising some form of oxygen scavenging technology, it has been achieved that the small amounts of oxygen entering the barrier bag despite its substantially airtight seal are eliminated. Moreover, oxygen scavenging may also be useful to eliminate any oxygen that entered the barrier bag during filling and closing of the barrier bag.

In a particular embodiment of the disclosure, closures and barrier bags are manufactured in a way that ensures that after one year of storage, the gas comprised in at least one void of the closure comprises less than about 10%, in particular less than about 5% oxygen.

The present disclosure also provides for a storage container comprising at least one closure for a product retaining container, wherein said storage container is filled with a gas which by composition and/or pressure is different from air and said closure comprises at least one void, which is at least partially filled with a gas or a gaseous mixture which by composition and/or pressure is different from air. Said gas may be as described above in detail for the gas which is comprised in the at least one void of the closure according to the present disclosure. In a particular embodiment of the present disclosure, the gas with which the storage container is filled and with which the at least one void of the closure is at least partially filled comprises > about 80 vol. % nitrogen. The storage container can be a barrier bag as described above, which provides a substantially airtight seal.

Figure 5:
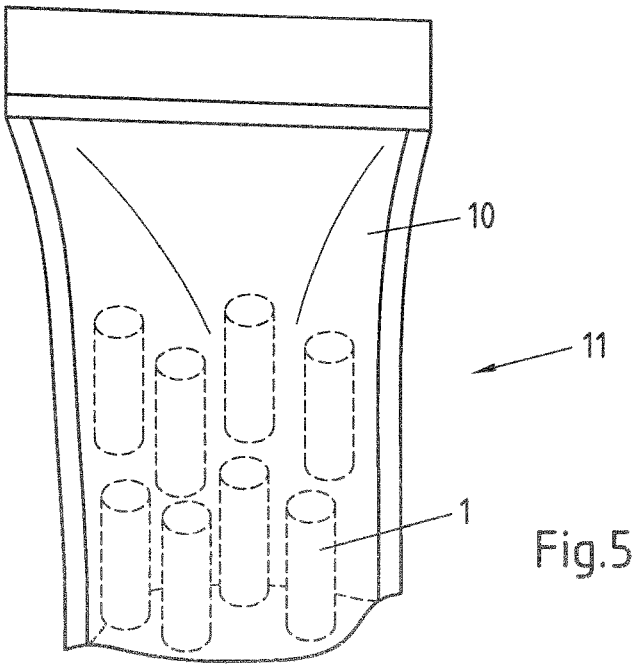
FIG. 5 is an exploded schematic view of a first exemplary embodiment of a barrier bag comprising at least one closure according to one embodiment of the present disclosure.
Figure 6:
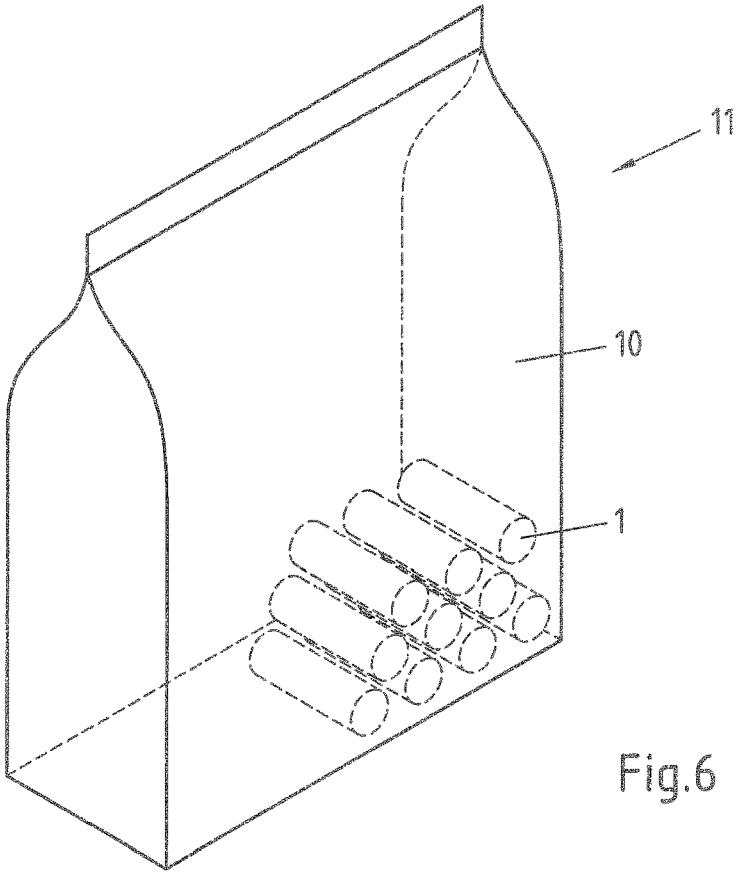
FIG. 6 is an exploded schematic view of a second exemplary embodiment of a barrier bag comprising at least one closure according to one embodiment of the present disclosure.
Figure 7:
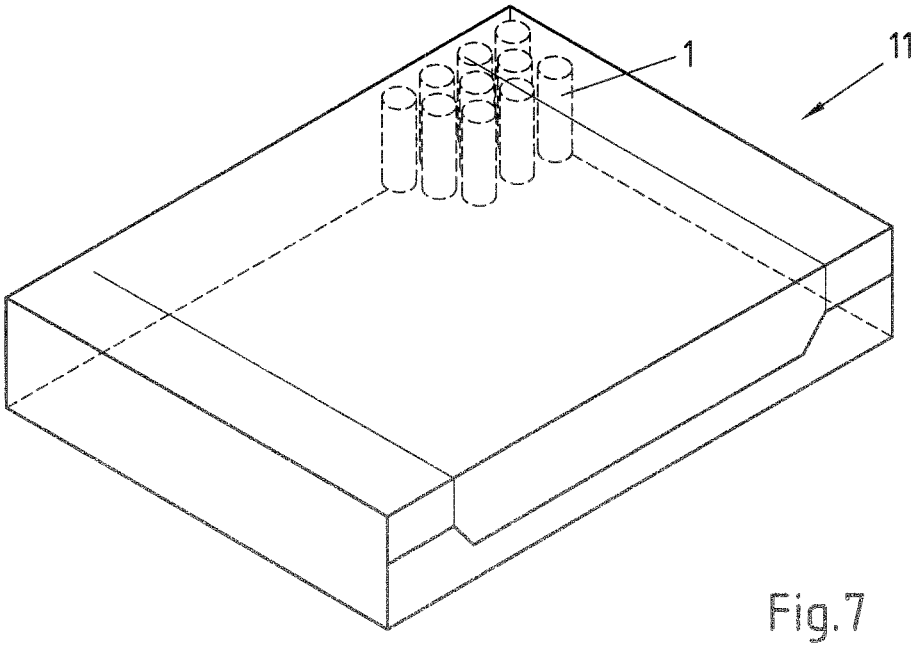
FIG. 7 is an exploded schematic view of a first exemplary embodiment of a storage container comprising at least one closure according to one embodiment of the present disclosure.
Figure 8:
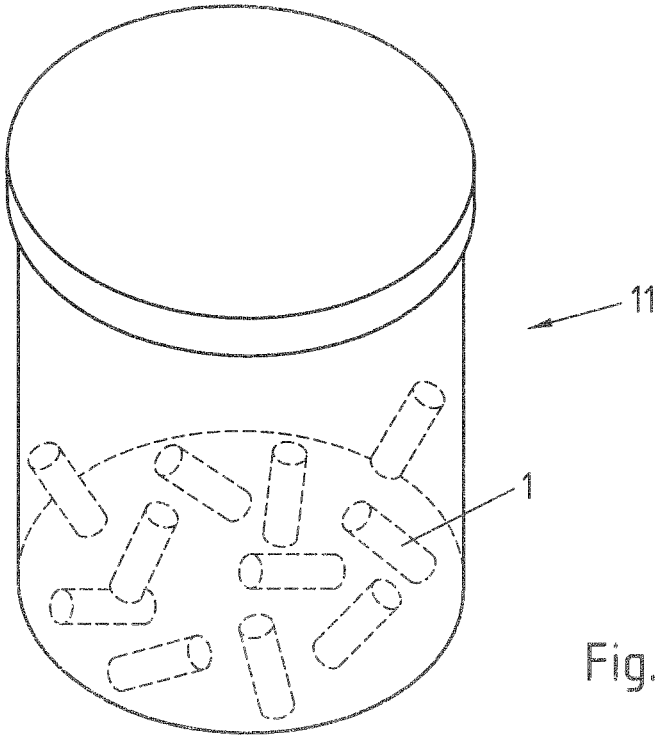
FIG. 8 is an exploded schematic view of a second exemplary embodiment of a storage container comprising at least one closure according to one embodiment of the present disclosure.

Referring now to FIGS. 5 to 8, storage containers 11 are illustrated comprising at least one closure 1 according to the present disclosure and having in the inside of the storage container 11 an atmosphere which is different from air. Referring now to FIGS. 5 and 6, the storage container 11 may be a barrier bag 10 comprising at least one closure 1. As described above, barrier bags useful as storage containers according to the present disclosure may vary in size. In a particular embodiment, the barrier bag 10 may be constructed to be able to fit from about 100 to about 1,000 closures, in another embodiment the barrier bag is much larger in size and may be constructed to be able to fit from about 5,000 and about 35,000 closures. The number of closures depicted in FIGS. 5 to 8 is illustrative only and closures are not necessarily drawn to scale. Referring now to FIGS. 7 and 8, the storage container 11 comprising at least one closure 1 may also be a box or a barrel providing a substantially airtight seal.

Having analyzed the phenomenon of closure desorption, the present inventors subsequently developed methods of inhibiting or fine-tuning closure desorption, so as to minimize or control the amount of oxygen ingress through closures. In addition, the present inventors have found that closure desorption may be exploited and modified to introduce a gas different from air into the container. Accordingly, the present disclosure also provides a use of a closure for a product retaining container to control and/or change the gas composition and/or pressure within the head-space of said product retaining container, wherein said closure comprises at least one void, which is at least partially filled with a gas or a gaseous mixture, which by composition and/or pressure is different from air. In a particular embodiment of the disclosure, a closure for a product retaining container is used to decrease the oxygen concentration within the head-space of said product retaining container.

In yet another embodiment, the present disclosure provides a method for controlling and/or changing the gas composition and/or pressure within the head-space of a product retaining container comprising the step of closing said container with a closure, wherein said closure comprises at least one void, which is at least partially filled with a gas or a gaseous mixture, which by composition and/or pressure is different from air. In a particular embodiment of the present disclosure, said change in gas composition is a decrease in oxygen concentration within the head-space of said product retaining container. The gas which at least partially fills the at least one void of the closure may be as described above in detail for the gas which is comprised in the at least one void of the closure according to the present disclosure. In a particular embodiment of the present disclosure, said gas comprises > about 80 vol. % nitrogen.

Finally, the present disclosure also provides a closure system comprising a product retaining container and a closure, wherein said closure comprises at least one void filled with a gas or a gaseous mixture which by composition and/or pressure is different from air. Closure and the gas or gaseous mixture comprised in the at least one void can be as described above. Referring now to FIG. 4, a closure system 9 comprising a closure 1 inserted into and sealing closed a product retaining container 5 is illustrated. In this embodiment, the product retaining container 5 is a bottle, in particular a wine bottle and the closure 1 is a natural or synthetic substantially cylindrically shaped bottle stopper.

EXAMPLES

Hereinafter, certain exemplary embodiments are described in more detail and specifically with reference to the examples, which, however, are not intended to limit the present disclosure.

Example 1

Closures with different OTRs, which are part of the Nomacorc® portfolio, were studied: Nomacorc® Classic+ having a length of 37 mm, 43 mm and 47 mm and Nomacorc® Premium having a length of 38 mm, 44 mm and 47 mm. The OTR of the closures was determined to be at 0.0244, 0.021, 0.019, 0.0197, 0.017 and 0.0159 cc/pkg*day for 100% $O_2$ respectively. The closures had been co-extruded from low density polyethylene (LDPE) materials. The lengths, diameters and weights of each closure were measured before corking.

The bottles used were clear glass 375 mL bottles and were equipped with a pst6 sensor from PreSens® Precision Sensing GmbH, Regensburg, Germany. The bottleneck profile of each bottle was measured with an automatic control calliper (Egitron® PerfiLab). From this dimensional information, the exact volume occupied by the closure in the neck was calculated.

Before corking, the bottles were purged with nitrogen gas at a pressure of 0.5 bar to flush oxygen out of the bottle. While keeping on purging, the bottles were placed in the corking machine (Fimer®). Purging was stopped right before the closure insertion using a single-head corker. All closures were compressed to a diameter of 15.8 mm. The vacuum was set at −0.6 bar in order to reach an internal pressure in the bottle between −0.1 and 0 bar. All bottles were then stored in a temperature-controlled cabinet at 23±1° C. and 50±5% relative humidity. Measurements were made at varying intervals during 20 days. Some measurements were made between 100 and 250 days in order to evaluate the evolution of the measurement values and its dispersion with time.

A Fibox 3 trace fiber optic oxygen meter purchased from PreSens® Precision Sensing GmbH, Regensburg, Germany, was used. The Fibox 3 measures the luminescence decay time of an immobilized luminophore. The luminophore is excited with a sinusoidal intensity-modulated monochromatic light delivered by an optical fiber and its decay time causes a time delay in the light signal emitted by the luminophore. This decay time, or phase angle, Φ, decreases in the presence of oxygen and is correlated to oxygen content.

The Pst6 sensor selected for this study can be used for a limited range of oxygen pressures ranging from 0 to 41.4 hPa. No specific calibration was done and the factory calibration delivered with the batch of dots was used throughout the study. The factory calibration of the sensors was performed at an atmospheric pressure of 975 mbars at 20° C. using pure nitrogen and a gas of 6% oxygen air saturated. A pst6 sensor had been glued inside each glass bottle using silicone glue prior to corking.

Data acquisition was performed using PST6v541 software. For each measurement, temperature was fixed at 23° C. and oxygen measurements were compensated accordingly. Readings were performed by applying the optical fiber in front of the dot and emitting excitation light through the glass wall.

The data were collected using Microsoft® Excel® 2003 software. Model fitting was performed with XLfit4 (IDBS, Guildford, Surrey, UK), which is a Microsoft® Excel® add-in software.

Oxygen ingress (expressed in hPa of oxygen partial pressure) into bottles filled with nitrogen and from which oxygen was flushed out was measured over time (20 days) using the Presens® methodology.

From the curve obtained and the mathematical model described by Dieval et al. (2011), the $O_2$ desorption from the closure was calculated. The following values were obtained:

| | length (cm) | overall density | OTR (cc/day 100% $O_2$) | desorption (mg $O_2$) | time for desorption (days) |
|---|---|---|---|---|---|
| Classic+ | 3.7 | 0.3 | 0.0244 | 1.23 | 130 |
| Classic+ | 4.3 | 0.3 | 0.021 | 1.42 | 150 |
| Classic+ | 4.7 | 0.3 | 0.019 | 1.52 | 200 |
| Premium | 3.8 | 0.335 | 0.0197 | 1.18 | 180 |
| Premium | 4.4 | 0.335 | 0.017 | 1.36 | 200 |
| Premium | 4.7 | 0.335 | 0.0159 | 1.43 | 250 |

Example 2

A synthetic wine closure of substantially cylindrical shape consisting of a foamed polymer core member and an outer skin was produced by means of coextrusion. Both, the material used and the method of extrusion were identical to the closures described in example 1. Directly after extrusion, the closures were cut into a length of 38, 44 and 47 mm and were placed and sealed into a barrier bag filled with nitrogen gas. After two weeks of storage and incubation in the barrier bag, the closures were removed and physical parameters, OTR and desorption were determined as described in example 1. The following values were obtained:

| | length (cm) | overall density | OTR (cc/day 100% $O_2$) | desorption (mg $O_2$) | time for desorption (days) |
|---|---|---|---|---|---|
| # 1 | 3.8 | 0.328 | 0.0127 | 0.16 | 290 |
| # 2 | 4.4 | 0.328 | 0.011 | 0.18 | 320 |
| # 3 | 4.7 | 0.328 | 0.01 | 0.20 | 350 |

Example 3

Wine bottle closures made entirely from natural cork and such comprising natural cork material are placed and sealed into a barrier bag filled with nitrogen gas. After two weeks of storage and incubation in the barrier bag, the closures are removed and desorption is determined as described in example 1. The desorption for the thus treated closures is about 0.2 mg $O_2$.

Example 4

The closures of examples 1, 2 and 3 were removed from the sealed barrier bags they were stored in and were used within the same day for the bottling of white wines. As white wines generally are intended to be consumed young, the amount of oxygen present in the wine bottle should be minimal, so as to ensure preservation of the fresh and fruity flavor characteristics. The closures produced in examples 2 and 3, showing very low desorption values, ensured optimal flavor preservation and prevented the formation of unpleasant aromas associated with oxidation.

It will thus be seen that the objects set forth above, among those made apparent from the preceding description, are efficiently obtained and, since certain changes may be made in carrying out the above method without departing from the scope of this disclosure, it is intended that all matter contained in the above description or shown in the accompanying drawings shall be interpreted as illustrative and not in a limiting sense. Furthermore, it should be understood that the details of the disclosure described in the foregoing detailed description are not limited to the specific embodiments shown in the drawings but are rather meant to apply to the disclosure in general as outlined in the summary and in the claims.

It is also to be understood that the following claims are intended to cover all of the generic and specific features of the disclosure herein described, and all statements of the scope of the disclosure which, as a matter of language, might be said to fall there between.

What is claimed is:

1. A closure for a product retaining container, wherein said closure comprises a plurality of voids, wherein the plurality of voids is at least partially filled with a gas which by composition and/or pressure is different from air, wherein the gas comprises a gas selected from the group consisting of an inert gas, nitrogen, argon, sulfur dioxide and carbon dioxide, or combinations thereof, wherein the gas has an oxygen concentration of below about 19.9 vol. %, wherein said closure is further defined as having a substantially cylindrical shape and comprising substantially flat terminating surfaces forming opposed ends of said closure, wherein the closure comprises an elongated, cylindrically shaped core member formed from foamed plastic material and comprising terminating end surfaces forming opposed ends of the core member; and at least one layer peripherally surrounding and intimately bonded to a cylindrical surface of the core member with the terminating end surfaces of the core member being devoid of said at least one layer;

wherein the closure comprises a synthetic closure which is capable of completely sealing any desired product in the container; and retaining the product in the container for a desired length of time substantially without any degradation of the product or degradation of the closure;

wherein the core member comprises a plurality of cells, wherein the plurality of voids is further defined as being a space inside the plurality of cells, wherein a cell size of the core member is substantially homogeneous throughout an entire length and diameter of the core member; and wherein the closure has a total amount of desorption after closing the container of less than about 1.00 mg oxygen.

2. The closure of claim 1, wherein the gas has a nitrogen concentration selected from the group consisting of > about 80 vol. % nitrogen, > about 90 vol. % nitrogen, > about 95 vol. % nitrogen, > about 97.5 vol. % nitrogen and about 100 vol. % nitrogen.

3. The closure of claim 1, wherein the gas has an oxygen concentration selected from the group consisting of below about 15.0 vol. %, below about 10.0 vol. %, below about 5.0 vol. %, below about 2.5 vol. % and below about 1.0 vol. %.

4. The closure of claim 1, wherein pressure in the plurality of voids is below standard atmospheric pressure.

5. The closure of claim 1, wherein said closure has an oxygen ingress rate selected from the group consisting of less than about 1.50 mg oxygen, less than about 1.25 mg oxygen, less than about 1.00 mg oxygen, less than about 0.50 mg oxygen, less than about 0.20 mg oxygen and less than about 0.10 mg oxygen per container in a first 100 days after closing the container.

6. The closure of claim 1, wherein said closure has a total amount of desorption after closing the container selected from the group consisting of less than about 0.50 mg oxygen, less than about 0.20 mg oxygen and less than about 0.10 mg oxygen.

7. The closure of claim 1, wherein the container is a bottle.

8. The closure of claim 1, wherein said closure further comprises an oxygen scavenging agent.

9. The closure of claim 8, wherein said oxygen scavenging agent is selected from the group consisting of ascorbates, sulfites, EDTA, hydroquinone, iron or other metallic active species, tannins and their salts and precursors, and combinations thereof.

10. The closure of claim 1, wherein said synthetic closure comprises one or more thermoplastic polymers.

11. The closure of claim 10, wherein said one or more thermoplastic polymers are selected from the group consisting of polyethylenes, metallocene catalyst polyethylenes, polybutanes, polybutylenes, polyurethanes, silicones, vinyl/based resins, thermoplastic elastomers, styrene block copolymers, polyesters, ethylenic acrylic copolymers, ethylene-vinyl-acetate copolymers, ethylene-methyl-acrylate copolymers, thermoplastic polyurethanes, thermoplastic olefins, thermoplastic vulcanizates, flexible polyolefins, fluoroelastomers, fluoropolymers, polytetrafluoroethylenes, and blends thereof, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers of polypropylene and copolymerizable ethylenically unsaturated comonomers, olefin block polymers, and mixtures thereof.

12. The closure of claim 1 having an overall density from about 100 kg/m$^3$ to about 800 kg/m$^3$, in particular from about 200 kg/m$^3$ to about 500 kg/m$^3$.

13. The closure of claim 1, wherein said closure is wholly or partially foamed.

14. The closure of claim 13, wherein foam of the wholly or partially foamed closure is further defined as being substantially closed cell foam.

15. The closure of claim 13, wherein foam of the wholly or partially foamed closure is further defined as having a cell size characterized by a range of between about 0.025 mm and about 0.5 mm, in particular between about 0.05 mm to about 0.35 mm.

16. The closure of claim 1, wherein the core member further comprises a fatty acid derivative or mixtures thereof.

17. The closure of claim 1, wherein said core member is further defined as comprising a density ranging between about 100 kg/m$^3$ to about 500 kg/m$^3$, in particular between about 200 kg/m$^3$ to about 350 kg/m$^3$.

18. The closure of claim 1, wherein said core member is further defined as comprising closed cells having an average cell size ranging from between about 0.02 mm to about 0.50 mm, in particular between about 0.05 mm and 0.1 mm and/or a cell density ranging between about 8,000 cells/cm$^3$ to about 25,000,000 cells/cm$^3$, in particular between about 1,000,000 cells/cm$^3$ to about 8,000,000 cells/cm$^3$.

19. A method for producing a closure for a product retaining container according to claim 1, the method comprising a step of introducing into said plurality of voids the gas which by composition and/or pressure is different from air and/or changing the pressure in said plurality of voids to a pressure different from standard atmospheric pressure.

20. The method of claim 19, wherein the gas has an oxygen concentration selected from the group consisting of below about 15.0 vol. %, below about 10.0 vol. %, below about 5.0 vol. %, below about 2.5 vol. % and below about 1.0 vol. %.

21. The method of claim 19, wherein the gas comprises > about 80 vol. % nitrogen.

22. The method of claim 21, wherein the gas comprises at least one of the following features (a) or (b):

(a) the gas has a nitrogen concentration selected from the group consisting of > about 80 vol. % nitrogen, > about 90 vol. % nitrogen, > about 95 vol. % nitrogen, > about 97.5 vol. % nitrogen and about 100 vol. % nitrogen; or (b) the gas has an oxygen concentration selected from the group consisting of below about 15.0 vol. %, below about 10.0 vol. %, below about 5.0 vol. %, below about 2.5 vol. % and below about 1.0 vol. %.

23. The method of claim 19, wherein the gas is introduced into said plurality of voids by diffusion.

24. The method of claim 23, wherein diffusion is facilitated by manufacturing said closure in an atmosphere which by composition and/or pressure is different from air.

25. The method of claim 23, wherein diffusion is facilitated or further facilitated by storing said closure in a sealed compartment comprising an atmosphere which by composition and/or pressure is different from air, wherein all external surfaces of said closure are contained within said sealed compartment and in contact with said atmosphere.

26. The method of claim 23, wherein the synthetic closure is formed by extrusion and is extruded into a compartment comprising an atmosphere which by composition and/or pressure is different from air.

27. The method of claim 25, wherein said atmosphere is nitrogen.

28. The method of claim 25, wherein said atmosphere is a full or partial vacuum.

29. The method of claim 25, wherein the sealed compartment is a barrier bag, which provides a substantially airtight seal.

30. The method of claim 29, wherein the barrier bag is substantially made of film selected from the group consisting of Nylon, EVOH, saran, saranex, metallized polyester, metallized nylon, PVDC, biaxially-oriented polyethylene terephthalate, Mylar and aluminum foil.

31. The method of claim 29, wherein the barrier bag comprises at least one layer comprising at least one oxygen scavenging agent and/or wherein the barrier bag comprises an oxygen-scavenging sachet or packet.

32. A storage container comprising an interior containing at least one closure for a product retaining container, wherein said interior is filled with a gas which by composition and/or pressure is different from air, said at least one closure comprises a plurality of voids at least partially filled with a gas or a gaseous mixture which by composition and/or pressure is different from air, all external surfaces of said at least one closure are contained within said storage container and in contact with the gas with which said interior is filled, said storage container is configured to be opened to permit removal of the at least one closure, said at least one closure is configured for enclosing the product retaining container for an edible food or beverage product following removal from the storage container, the gas or gaseous mixture with which the plurality of voids is at least partially filled has an oxygen concentration below about 19.9 vol. %, and the gas with which the interior is filled is selected from the group consisting of an inert gas, nitrogen, argon, sulphur dioxide and carbon dioxide, or combinations thereof.

33. The storage container of claim 32, wherein the gas or gaseous mixture comprises at least one of the following features (a) or (b):

(a) the gas or gaseous mixture has a nitrogen concentration selected from the group consisting of > about 80 vol. % nitrogen, > about 90 vol. % nitrogen, > about 95 vol. % nitrogen, > about 97.5 vol. % nitrogen and about 100 vol. % nitrogen; or (b) the gas or gaseous mixture has an oxygen concentration selected from the group consisting of below about 15.0 vol. %, below about 10.0 vol. %, below about 5.0 vol. %, below about 2.5 vol. % and below about 1.0 vol. %.

34. The storage container of claim 32, wherein said storage container is further defined to be a barrier bag, which provides a substantially airtight seal.

35. The storage container of claim 34, wherein the barrier bag comprises a polymeric film selected from the group consisting of Nylon, EVOH, saran, saranex, metallized polyester, metallized nylon, PVDC, biaxially-oriented polyethylene terephthalate, Mylar and aluminum foil.

36. A method for controlling and/or changing the gas composition and/or pressure within a head-space of a product retaining container comprising a step of closing said container with a closure according to claim 1.

37. The method of claim 36, wherein said change in gas composition is further defined to be a decrease in oxygen concentration.

38. A closure system comprising a product retaining container and the closure of claim 1.

39. The closure of claim 1, wherein the closure comprises an extruded foam plastic material containing the plurality of voids, the gas comprises a gas introduced by diffusion into the plurality of voids, and the gas differs by composition from a gaseous blowing agent employed in creation of the plurality of voids.

40. The closure of claim 1, wherein the gas comprises a blowing agent and an introduced gas introduced by diffusion into the plurality of voids, and partial pressure of the introduced gas is greater than a partial pressure of the blowing agent.

41. The closure of claim 39, wherein the gas within the plurality of voids comprises a concentration gradient produced by introduction of gas into the plurality of voids by diffusion from a high pressure gas environment.

* * * * *